US005904079A

United States Patent [19]

Tsuge et al.

[11] Patent Number: 5,904,079

[45] Date of Patent: May 18, 1999

[54] SCREW FEEDING DEVICE IN CONTINUOUS SCREW DRIVING TOOL

[75] Inventors: Kazunori Tsuge; Tomohiro Ukai, both of Anjo, Japan

[73] Assignee: Makita Corporation, Anjo, Japan

[21] Appl. No.: 08/900,858

[22] Filed: Jul. 25, 1997

[30] Foreign Application Priority Data

Jul. 26, 1996 [JP] Japan ..... 8-197729
Oct. 22, 1996 [JP] Japan ..... 8-279476

[51] Int. Cl.[6] ..... B25B 23/06

[52] U.S. Cl. ..... 81/434; 81/57.37

[58] Field of Search ..... 81/434, 57.37, 81/433

[56] References Cited

U.S. PATENT DOCUMENTS

| | | | |
|---|---|---|---|
| 4,059,034 | 11/1977 | Hornung | 81/57.37 |
| 4,428,261 | 1/1984 | Takatsu et al. | 81/434 |
| 5,083,483 | 1/1992 | Takagi . | |
| 5,341,706 | 8/1994 | Takagi . | |
| 5,687,624 | 11/1997 | Tsuge et al. | 81/57.37 |

FOREIGN PATENT DOCUMENTS

| | | |
|---|---|---|
| 0738564 | 10/1996 | European Pat. Off. . |
| 2641828 | 3/1978 | Germany . |
| 4119925 | 1/1992 | Germany . |
| 4219095 | 12/1993 | Germany . |
| 19526543 | 1/1996 | Germany . |
| 349879 | 4/1991 | Japan . |
| 3166066 | 7/1991 | Japan . |
| 4111781 | 4/1992 | Japan . |

*Primary Examiner*—David A. Scherbel
*Assistant Examiner*—Lee Wilson
*Attorney, Agent, or Firm*—Dennison, Meserole, Pollack & Scheiner

[57] ABSTRACT

A screw feeding device in a continuous screw driving tool includes a casing mounted on a tool body of the continuous screw driving tool. A feeder box is reciprocally movable within the casing and a ratchet arm is reciprocally pivotable as the feeder box is reciprocally moved. An intermediate gear is connected to the ratchet arm by mechanism of a one-way clutch and is rotatable by a predetermined angle as the ratchet arm is pivoted in one direction. A ratchet wheel has feeding claws engageable with a screw carrying belt and has a gear part engaged with the intermediate gear, so that the ratchet wheel is rotated in a feeding direction as the intermediate gear is rotated and that the screw carrying belt is fed by a distance of one pitch of screws carried by the screw carrying belt for each reciprocal movement of the feeder box.

12 Claims, 25 Drawing Sheets

SCREW FEEDING DEVICE IN CONTINUOUS SCREW DRIVING TOOL

BACKGROUND OF THE INVENTION

1. Field of the Invention

The present invention relates to a screw feeding device in a continuous screw driving tool and particularly to a screw feeding device for feeding screws carried on a screw carrying belt one by one by moving the screw carrying belt by a distance corresponding to one pitch of the carried screws in response to one cycle of a screw driving operation.

2. Description of the Prior Art

As shown in FIG. 27, the conventional continuous screw driving tool includes a screw feeding device including a casing 61 and a feeder box slidably movable within a feeder box. When the tool is adapted to drive a screw into an article such as a picture frame in a position adjacent a stepped portion D of the article, a lower end 61*a* of the casing 61 of the screw feeding device may abut on an upper surface of the stepped portion D as the casing 61 is lowered for driving the screw. This may cause a problem that the stepped portion D is damaged by the casing 61.

For preventing the article from such a damage, Japanese Laid-Open Patent Publication Nos. 3-49879 and 4-111781 have proposed to determine an upper stroke end of the feeder box 60 such that the distance between the lower end 61*a* of the case 61 and a lower end of the feeder box 60 is greater than a predetermined height L0 of the stepped portion D when the feeder box 60 is in its upper stroke end. Here, the height L0 is appropriately selected.

In order to provide such a greater distance, a screw feeding device of the continuous screw driving tool of the above publications has constructed to include a feeding arm 65 which is pivotally mounted on the feeder box 60 as shown in FIG. 28. The feeding arm 65 has one end engaged with a feeding pin 63 extending laterally from a ratchet wheel 62 and has the other end engaged with a guide slot 64 having a bent portion and formed in a lateral surface of the casing 61.

The ratchet wheel 62 is rotatably supported by the feeder box 60 and has a plural number of feeding claws 62*a* formed on its periphery. With the feeding claws 62*a* engaged with a screw carrying belt S, the ratchet wheel 62 is rotated in a direction indicated by an arrow in FIG. 28, so that the screw carrying belt S is moved leftwardly by a distance corresponding to one pitch of the screws. Such rotation of the ratchet wheel 62 is produced by the movement of the casing 61 in the downward direction. Thus, as the casing 61 is moved downwardly for driving the screw, the feeding arm 65 is pivoted by a predetermined angle in a counterclockwise direction indicated by an arrow in FIG. 28 due to the movement of the other end of the feeding arm 65 along the guide slot 64, so that the feeding pin 63 in engagement with one end of the feeding arm 65 is forced to be moved in a feeding direction of the screw carrying belt S.

The feeding arm 65 interposed between the ratchet wheel 62 and the casing 61 serves to provide a remote control of the rotation of the ratchet wheel 62 to be caused by the downward movement of the casing 61, so that the lower stroke end of the casing 61 can be determined to prevent the stepped portion D from being damaged while a sufficient stroke of movement of the feeder box 60 relative to the casing 61 can be ensured.

However, with the conventional screw feeding device, one end of the feeding arm 65 is always in engagement with the feeding pin 63 which extends laterally from the ratchet wheel 62. Therefore, one end of the feeding arm 65 as well as the feeding pin 63 tends to be soon worn, so that the conventional screw feeding device still involves the problem that it has less durability.

SUMMARY OF THE INVENTION

It is, accordingly, an object of the present invention to provide a screw feeding device in a continues screw driving tool which is excellent in durability while a lowermost position of a casing can be limited to prevent damage to an article into which a screw is driven.

According to the present invention, there is provided a screw feeding device in a continuous screw driving tool, comprising:

- a casing mounted on a tool body of the continuous screw driving tool;
- a feeder box reciprocally movable within the casing;
- a ratchet arm reciprocally pivotable as the feeder box is reciprocally moved;
- an intermediate gear connected to the ratchet arm by means of a one-way clutch, the intermediate gear being rotatable by a predetermined angle as the ratchet arm is pivoted in one direction; and
- a ratchet wheel having feeding claws engageable with a screw carrying belt and having a gear part engaged with the intermediate gear, so that the ratchet wheel is rotated in a feeding direction as the intermediate gear is rotated and that the screw carrying belt is fed by a distance of one pitch of screws carried by the screw carrying belt for each reciprocal movement of the feeder box.

With this construction, since the pivotal movement of the ratchet arm is transmitted to the ratchet wheel by means of the intermediate gear, the upper stroke end of the feeder box can be appropriately determined such that an appropriate space is provided between the lower end of the casing and a work when the screw has been completely driven into the work or when the casing has reached its lower stroke end. Therefore, the casing may not cause damage to the work even if the screw is to be driven in a position adjacent a stepped portion of the work In addition, the screw feeding device of the present invention does not require a feeding pin which is normally provided on a ratchet wheel of the conventional screw feeding device and which is always in engagement with a feeding arm to receive concentrated wear during transmission of rotation. Thus, the wear is dispersed at the teeth of the intermediate gear and the teeth of the gear part of the ratchet wheel, so that the screw feeding device of the present invention is excellent in its durability.

In a preferred embodiment, the ratchet wheel is rotatably supported by the feeder box about a first axis, and the intermediate gear is rotatably supported by the feeder box about a second axis parallel to the first axis. The second axis is displaced from the first axis in a direction opposite to a driving direction of the screws.

With this construction, a mechanism such as a releasing button for releasing the one-way clutch associated with the one-way clutch or the intermediate gear can be positioned deeper into the feeder box, so that the mechanism associated with the one-way clutch or the intermediate gear may not cause improper operation which may be caused by dusts or foreign materials.

In contrast, with the conventional screw feeding device such as that disclosed in Japanese Laid-Open Patent Publication Nos. 3-49879 and 4-111781 described in the Description of the Prior Art, an engaging member for preventing rotation of a ratchet wheel in a direction opposite to a feeding direction is operable by an operator to permit rotation of the ratchet wheel in the direction opposite to the feeding direction so as to permit withdrawal of a screw carrying belt. To this end, a lever for operation of the engaging member is disposed in a position adjacent the ratchet wheel where the ratchet wheel or other parts are exposed to the outside and where dusts or foreign materials are liable to enter. Therefore, there has been a problem that the lever may not be operated properly.

In a preferred embodiment of the present invention, a releasing mechanism is provided for releasing the one-way clutch for permitting rotation of the ratchet wheel in a direction opposite to the feeding direction.

The ratchet arm is movable in an axial direction between a clutch operating position and a clutch releasing position, and the releasing mechanism includes a releasing button operable to move the ratchet arm from the clutch operating position to the clutch releasing position.

A spring is provided for normally keeping the ratchet arm in the clutch operating position. The releasing button is mounted on the feeder box for movement in a direction perpendicular to the axial direction of the ratchet arm, and the ratchet arm includes an inclined surface for abutment on one end of the releasing button, so that the ratchet arm is moved toward the clutch releasing position through abutment of one end of the releasing button on the inclined surface when the releasing button is pushed against the biasing force of the spring.

The ratchet arm and the intermediate gear may be supported on a common shaft, so that the screw feeding device may be small and simple in construction.

In addition, it is preferable that the screw feeding device includes a resistance member for providing predetermined resistance against rotation of the ratchet wheel. With this construction, the ratchet wheel may be prevented from excessive rotation and may be reliably stopped in a predetermined position after the ratchet wheel has been rotated in the feeding direction. This may also prevent the ratchet wheel from backlash in both the feeding direction and the direction opposite thereto.

The resistance member may be a leaf spring having one end mounted on the feeder box and having the other end or a free end which resiliently contacts an outer periphery of the ratchet wheel.

If the feeding claws are formed on the outer periphery of the ratchet wheel, the free end of the leaf spring may include a proximal end which is brought to abut on one of the feeding claws in the direction opposite to the feeding direction when the screw carrying belt has been moved to a position for driving the screw.

In a further preferable embodiment, a detent claw mechanism is provided and includes a detent claw mounted on the feeder box and engaging claws provided on the intermediate gear for engagement with the detent claw. The releasing mechanism is operable to release the engagement between the detent claw and the engaging claws at the same time the one-way clutch is released.

With this construction, the detent claw is operable to engage the intermediate gear so as to prevent rotation of the intermediate gear in the direction opposite to the feeding direction, so that the ratchet wheel is indirectly prevented from rotation in the same direction by the detent claw. Therefore, the feeding claws of the ratchet wheel of the present invention may cause less wear than the wear caused in the conventional device in which a detent claw directly engages the feeding claws of the ratchet wheel, so that the wear of the feeding claws may be substantially decreased.

In addition, the movement of the screw carrying belt in the direction opposite to the feeding direction can be performed by operating the releasing mechanism which is a separate mechanism from the detent claw. Although the detent claw is moved toward its disengaging position as the intermediate gear is rotated in the feeding direction, the releasing mechanism is operated only when the screw carrying belt is to be moved in the direction opposite to the feeding direction. Therefore, the releasing mechanism and its associated parts may be improved in durability in comparison with the construction where the detent claw and the releasing member are formed by one piece member.

In this connection, preferably, the ratchet arm is movable relative to the feeder box in an axial direction between a clutch operating position and a clutch releasing position, and the detent claw is movable relative to the feeder box between an engaging position with the engaging claws and a disengaging position therefrom The releasing mechanism includes a releasing button for moving the ratchet arm from the clutch operating position to the clutch releasing position and for moving the detent claw from the engaging position to the disengaging position.

The detent claw may include a releasing member for abutment on the releasing button when the releasing button is pushed into the feeder box.

The invention will become more fully apparent from the claims and the description as it proceeds in connection with the drawings.

DETAILED DESCRIPTION OF THE PREFERRED EMBODIMENTS

A first embodiment of the present invention will now be described with reference to FIGS. 1 to 16.

Figure 1:
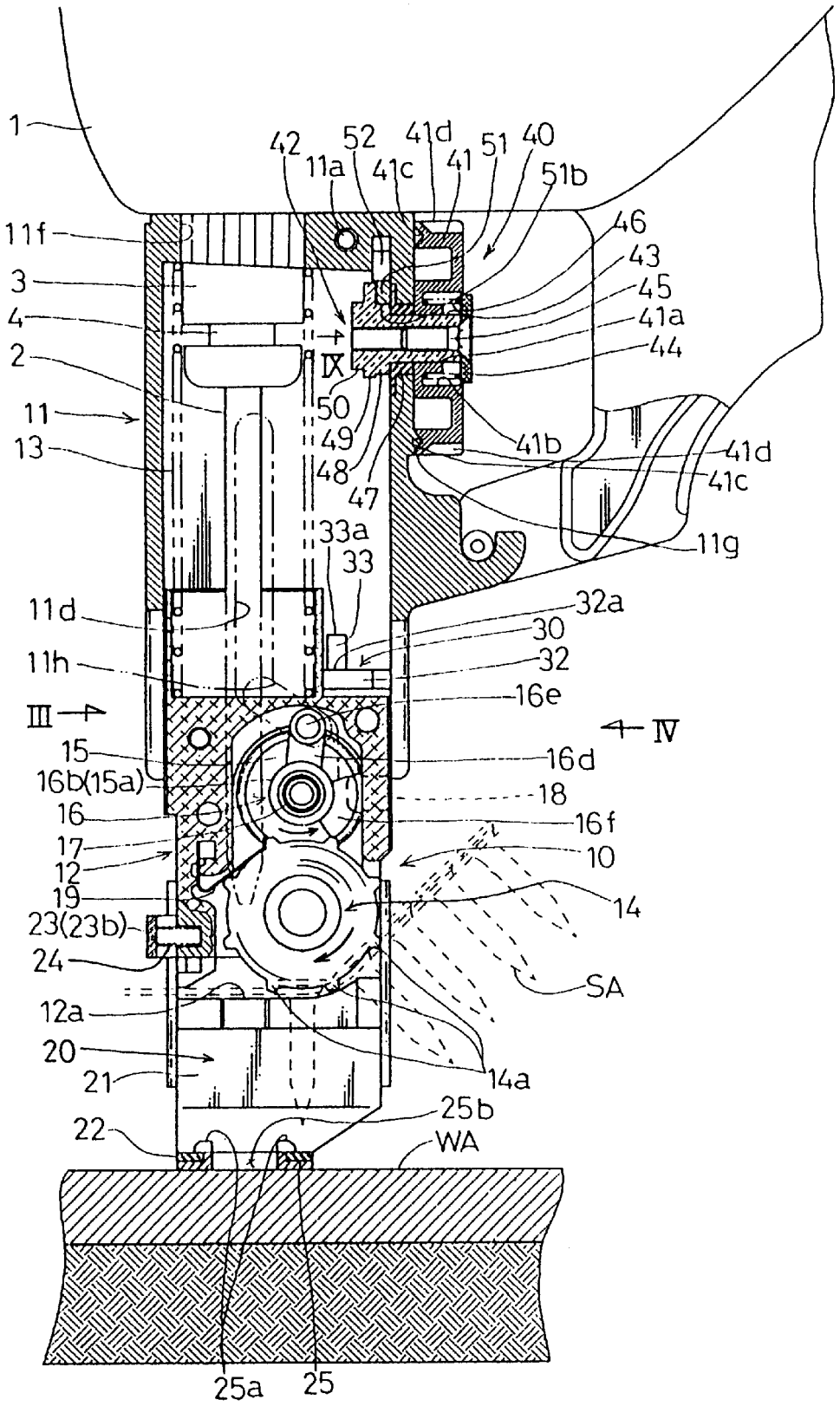
FIG. 1 is a vertical sectional view of a screw feeding device in a continuous screw driving tool according to a first embodiment of the present invention.

A screw feeding device 10 of this embodiment is shown in FIG. 1 and is provided on a lower portion of a tool body 1 of a continues screw driving tool. FIG. 1 shows only the lower portion of the tool body 1. The construction of the tool body 1 is the same as that of the conventional tool, and therefore, the tool body 1 will be described in brief. A spindle 4 extends downwardly from the tool body 1 and is rotatably driven by a motor (not shown) accommodated within the tool body 1. The spindle 4 is rotatably supported by a cylindrical bearing 3. A driver bit 2 is inserted into a lower end of the spindle 4 and is rotatable therewith on the same axis.

The screw feeding device 10 includes a tubular casing 11 having a substantially rectangular configuration in section. The casing 11 is split into two halves each having a mounting hole half 11*f* formed in an upper end plate for receiving the cylindrical bearing 3. The casing 11 is secured to the bearing 3 by tightening a fixing screw (not shown) which is in engagement with threaded holes 11*a* (only one shown in the drawings) formed in the split halves of the casing 11, so that the casing 11 is held in a position to extend downwardly from the tool body 1. The driver bit 2 extends through the casing 11 thus mounted on the tool body 1.

Figure 3:
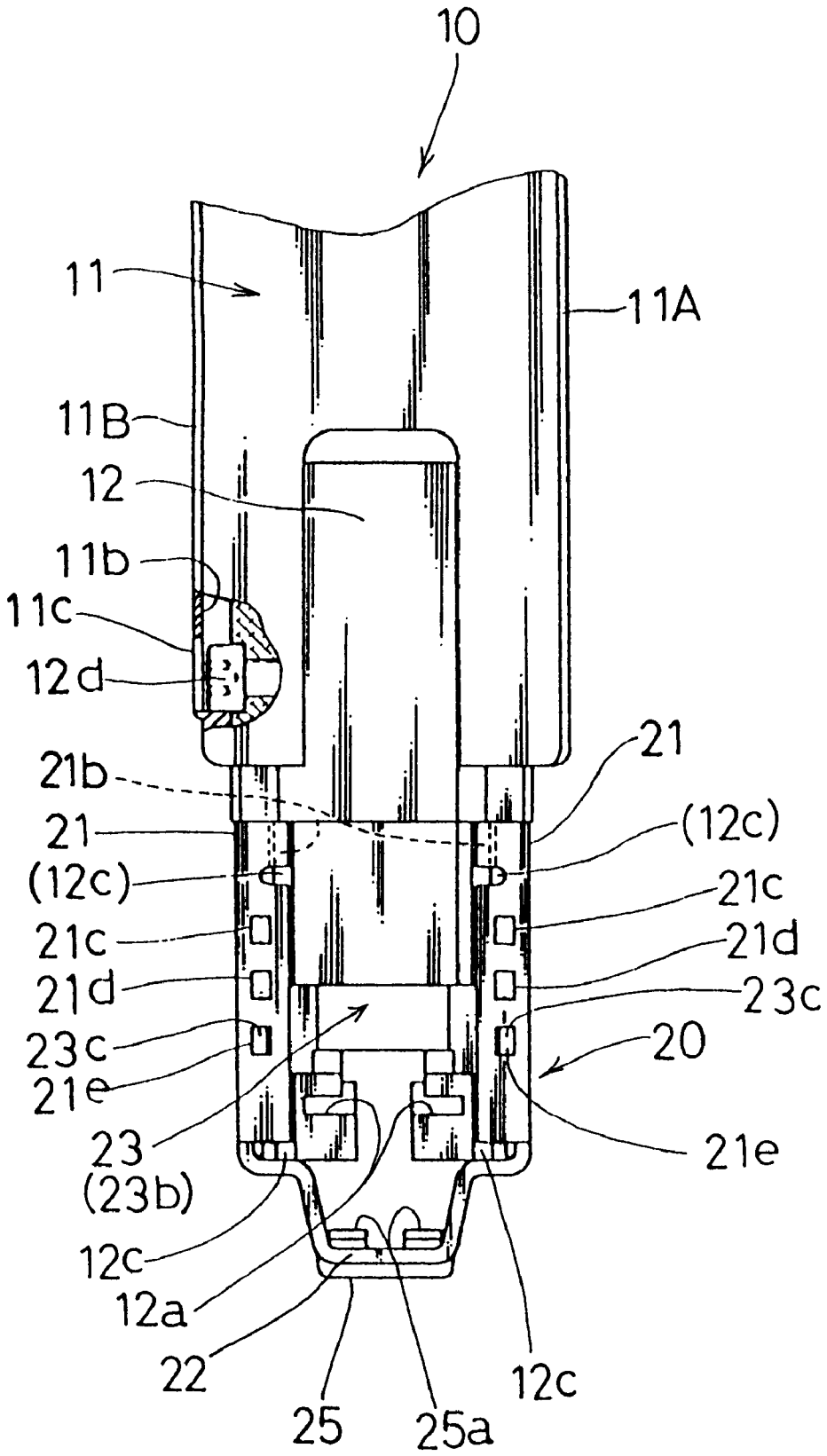
FIG. 3 is a view in a direction of arrow III in FIG. 1 and showing a front view of the lower portion of the casing, a feeder box and the stopper base.
Figure 4:
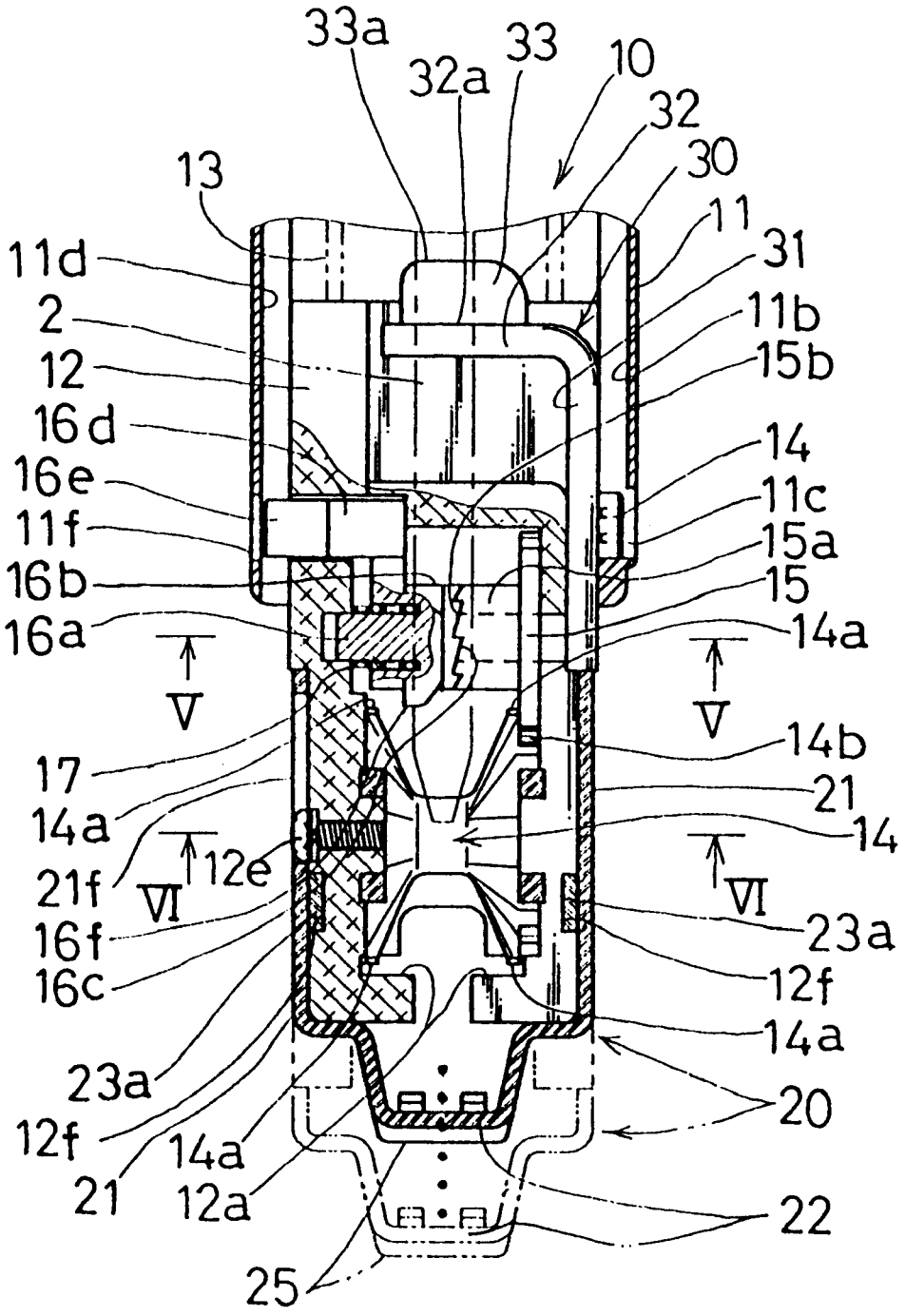
FIG. 4 is a vertical sectional view as viewed in a direction of arrow IV in FIG. 1.

A feeder box 12 is mounted within the casing 11 so as to be vertically reciprocally moved therewithin. The feeder box 12 is normally biased in a downward direction by a compression spring 13. The driver bit 2 extends through the feeder box 12 and protrudes downwardly from the lower end of the feeder box 12. As shown in FIGS. 3 and 4, a bolt 12*d* is in engagement with one lateral surface of the feeder box 12 and has a head positioned within a guide recess 11*b* which is formed in an inner surface of one lateral wall 11B of the casing 11. The guide recess 11*b* has a lower end, so that the head of the bolt 12*d* defines a lower stroke end of the feeder box 12 through abutment on the lower end of the guide recess 11*b*. The lateral wall 11B has a through hole 11*c* formed therein in communication with the guide recess 11*b* adjacent its lower end, so that the bolt 12*d* can be tightened and loosened by inserting an appropriate tool such as a screwdriver into the through hole 11*c*. When the bolt 12*d* has been loosened to be removed from the feeder box 12, the feeder box 12 can be removed from the casing 11. A mechanism for determining the upper stroke end of the feeder box 12 will be explained later.

The feeder box 12 has a substantially bifurcated configuration and has a pair of guide bases 12*a* formed on its lower portion. The guide bases 12*a* confront each other and serve to provide a guide for a screw carrying belt S. A ratchet wheel 14 is rotatably supported on the feeder box 12 in a position above the guide bases 12*a*. As will be seen from FIGS. 4 and 6, the ratchet wheel 14 has a configuration like a Japanese hand drum and has both ends each formed with a plurality of feeding claws 14*a* spaced from each other by a predetermined distance in a circumferential direction. The screw carrying belt S has two parallel rows of a series of engaging holes formed on both sides thereof. The engaging holes in each raw are spaced from each other by the same distance as the pitch of the feeding claws 14*a*. The ratchet wheel 14 is intermittently rotated by a predetermined angle in a direction indicated by an arrow in FIG. 1 or a clockwise direction with the feeding claws 14*a* on both ends of the ratchet wheel 14 engaged with the engaging holes of the screw carrying belt S, so that the screw carrying belt S is moved leftwardly as viewed in FIG. 1 by a distance corresponding to a pitch of the screws carried thereon.

Figure 5:
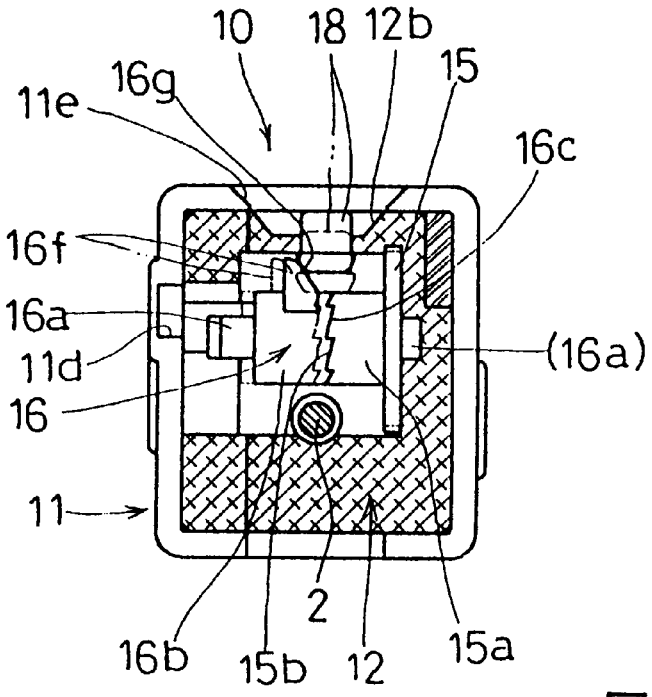
FIG. 5 is a sectional view taken along line V—V in FIG. 4.

As shown in FIG. 4, one end of the ratchet wheel 14 has a gear part 14*b* formed thereon. An intermediate gear 15 is in engagement with the gear part 14*b* and is rotatably supported on a support shaft 16*a* of a ratchet arm 16. As shown in FIG. 5, the ratchet arm 16 is pivotally movable about the axis of the support shaft 16*a* and is slidably movable with the support shaft 16*a* in an axial direction (right and left directions as viewed in FIGS. 4 and 5). The support shaft 16*a* is supported on the feeder box 12 and extends between the bifurcated parts of the feeder box 12. A cylindrical portion 16*b* is formed on substantially the central portion of the support shaft 6*a* in its longitudinal direction. Saw teeth-like engaging claws 16*c* are formed on one end of the cylindrical portion 16*b* and are spaced from each other in a circumferential direction by a predetermined distance.

A cylindrical portion 15*a* is formed on the intermediate gear 15 and confronts the cylindrical portion 16*b* of the ratchet arm 16. The cylindrical portion 15*a* has saw teeth-like engaging claws 15*b* formed on its one end for engagement with the engaging claws 16*c*, so that the engaging claws 15*b* and 16*c* cooperate to form a one-way clutch. When the ratchet arm 16 is pivoted by a predetermined angle in a feeding direction with the engaging claws 15*b* and 16*c* engaged with each other, the intermediate gear 15 is rotated in the direction in a counterclockwise direction as indicated by an arrow in FIG. 1, so that the ratchet wheel 14 is rotated to move the screw carrying belt S by the distance corresponding one pitch of the screws.

A compression spring 17 is interposed between the cylindrical portion 16*b* on the side of the ratchet arm 16 and the feeder box 12, so that the ratchet arm 16 is normally biased in a right direction as viewed in FIG. 4. Thus, the engaging claws 16*c* on the side of the ratchet arm 16 is forced to be pressed on the engaging claws 15*b* on the side of the intermediate gear 15, so that the engaging claws 16*c* and 15*b* are normally held in engagement with each other.

When the ratchet arm 16 is pivoted in a direction opposite to the feeding direction (a clockwise direction as viewed in FIG. 1), the ratchet arm 16 is moved leftwardly as viewed in FIG. 4 against the biasing force of the compression spring 17, so that the engaging claws 16*c* and 15*b* are disengaged from each other. As the engaging claws 16*c* and 15*b* are thus disengaged, the ratchet arm 16 is pivoted relative to the intermediate gear 15 in the direction opposite to the screw feeding direction by an angle corresponding to one pitch of the screws.

A substantially L-shaped support leg 16*d* extends laterally from the lateral surface of the cylindrical portion 16*b* of the ratchet arm 16 and has one end on which a guide roller 16*e* is rotatably mounted. The guide roller 16*e* is in engagement with a guide slot 11*d* formed in the inner surface of the casing 11. An arcuate slot 12*h* is formed in the feeder box 12, so that the guide roller 16*e* is moved within the arcuate slot 12*h* as the ratchet arm 16 is pivotally moved as will be hereinafter explained.

Figure 2:
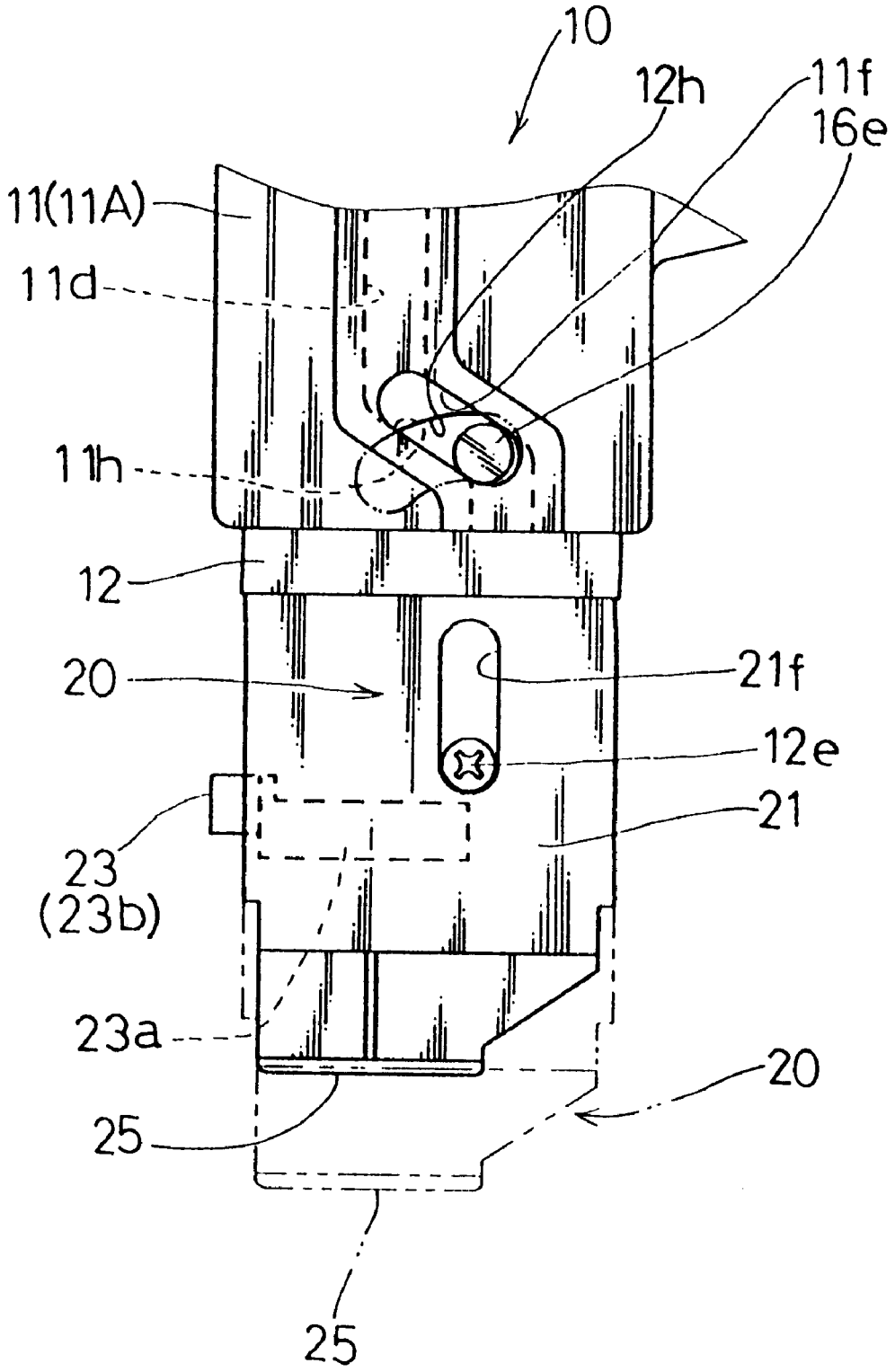
FIG. 2 is a side view of the screw feeding device and showing a lower portion of a casing and a stopper base.

As shown in FIG. 2, the guide recess lid includes a slant portion 11*h* in a position adjacent its lower end. As the feeder box 12 is reciprocally moved relative to the base 11, the guide roller 16*e* is reciprocally moved along the slant portion 11*h*, so that the ratchet arm 16 is forced to be pivoted alternately in the feeding direction and the direction opposite thereto by the predetermined angle. When the feeder box 12 is moved upwardly relative to the casing 11, the guide roller 16*e* is moved leftwardly as viewed in FIG. 2, so that the ratchet arm 16 is pivoted in the feeding direction.

In contrast, when the feeder box 12 is moved downwardly relative to the casing 11, the guide roller 16*e* is moved rightwardly as viewed in FIG. 2, so that the ratchet arm 16 is pivoted in the direction opposite to the feeding direction. In this case, however, since the engaging claws 16*c* and 15*b* are disengaged from each other by the movement of the ratchet arm 16 in the axial direction against the biasing forth of the spring 17, the intermediate gear 15 as well as the ratchet wheel 14 is not rotated but is held in a position which was taken when the screw carrying belt S has been moved by the distance of one pitch of the screws.

As shown in FIG. 2, an elongated hole-like window 11*f* is formed in the casing 11 along the slant portion 11*h* of the guide recess 11*d*. The lower end of the guide recess 11*d* is open at the lower end of the casing 11, so that the guide roller 16*e* can be easily inserted into the guide slot during an assembling operation.

As shown in FIG. 5, a releasing portion 16*f* is formed on the lateral surface of the cylindrical portion 16*b* of the ratchet arm 16. The releasing portion 16*f* has an inclined surface 16*g* inclined outwardly leftwardly as viewed in FIG. 5. A releasing button 18 is mounted on the feeder box 12 and is movable in and out from the feeder box. The releasing button 18 has a head which is in abutment on the inclined surface 16*g*. Since the ratchet arm 16 is biased by the compression spring 17 in a direction for engagement of the engaging claws 16*c* with the engaging claws 15*b* of the intermediate gear 15, the head of the releasing button 18 is normally held in abutment on the inclined surface 16*g*. In addition, the biasing force of the compression spring 17 as applied forces the releasing button 18 in a direction outwardly of the feeder box 12 (upwardly as viewed in FIG. 5).

As shown in FIG. 1, the releasing portion 16*f* has a fan-like configuration extending in the circumferential direction of the cylindrical portion 16*b*. The circumferential length of the releasing portion 16*f* is determined to be at least the possible pivotal angle of the ratchet arm 16, so that the head of the releasing button 18 is always held in abutment on the inclined surface 16*g* of the releasing portion 16*f* irrespective of the pivotal movement of the ratchet arm 16.

The head of the releasing button 18 has a conical lateral surface having an inclination angle corresponding to the inclination of the inclined surface 16*g*, so that the movement of the releasing portion 16*f* in the axial direction can be effectively converted into the movement of the releasing button 18 in the direction perpendicular to the moving direction of the releasing portion 16*f*. In addition, the head of the releasing button 18 has an outwardly expanding flange-like configuration, so that the releasing button 18 is prevented from being removed from the feeder box 12 irrespective of the biasing force applied from the releasing portion 16*f*.

A cut-out slot 11*e* and a concave portion 12*b* having a through hole for receiving the releasing button 18 are formed in the casing 11 and the feeder box 12, respectively, so that an operator can access the releasing button 18 for pushing the same from the outside. Here, the releasing button 18 may not extend from an outer surface of the casing 11 when the releasing button 18 is not pushed into the casing 11.

With this construction, the releasing button 18 is normally held in a position protruding into the concave portion 12*b* and the cut-out slot 11*e* as indicated by solid lines in FIG. 5. When the operator pushes the releasing button 18, the releasing button 18 is retracted to a position indicated by chain lines in FIG. 5, resulting in that the ratchet arm 16 is moved leftwardly against the biasing force of the spring 17 by the interaction between the head of the releasing button 18 and the inclined surface 16*g*, so that the engaging claws 16*c* are disengaged from the engaging claws 15*b*.

When the engaging claws 16*c* are disengaged from the engaging claws 15*b*, the ratchet arm 16 and the intermediate gear 15 are disconnected from each other in the rotational direction, so that the ratchet wheel 14 as well as the intermediate gear 15 is allowed to be rotated in a direction opposite to the direction for feeding the screw carrying belt S or the feeding direction. Therefore, the operator can draw out the screw carrying belt S from the screw feeding device 10 in a direction opposite to the direction for feeding the screw carrying belt S (right direction as viewed in FIG. 1).

As shown in FIG. 1, a leaf spring 19 has one end mounted on the feeder box 12 and is positioned adjacent the ratchet wheel 14. The leaf spring 19 has the other end or a fee end pressed on the circumferential surface of the ratchet wheel 14, so that the leaf spring 19 provides a resistance force against rotation of the ratchet wheel 14. Thus, in the feeding direction (the direction indicated by the arrow in FIG. 1), the ratchet wheel 14 is rotated against the pressure applied from the free end of the leaf spring 19 while the free end of the leaf spring 19 is resiliently bent outwardly of the ratchet wheel 14. With the resistance force applied from the leaf spring 19, the ratchet wheel 14 may not be excessively rotated but can be reliably stopped after it has been rotated by the predetermined angle.

The resistance force applied from the leaf spring 19 serves to eliminate backlash of the ratchet wheel 14 in the rotational direction. In addition, since the length of the leaf spring 19 is determined such that the proximal edge of the free end of the leaf spring 19 is brought to abut on one of the feeding claws 14*a* on the side opposite to the feeding direction after the ratchet wheel 14 has been rotated to feed the screw carrying belt S by the distance of one pitch of the screws. This may also prevent the ratchet wheel from rotating in the direction opposite to the feeding direction. Further, the rotation of the ratchet wheel in the direction opposite to the feeding direction may be also prevented by the intermediate gear 15 since the intermediate gear 15 is stopped after the screw carrying belt S has been fed by the distance of one pitch of the screws.

Figure 11:
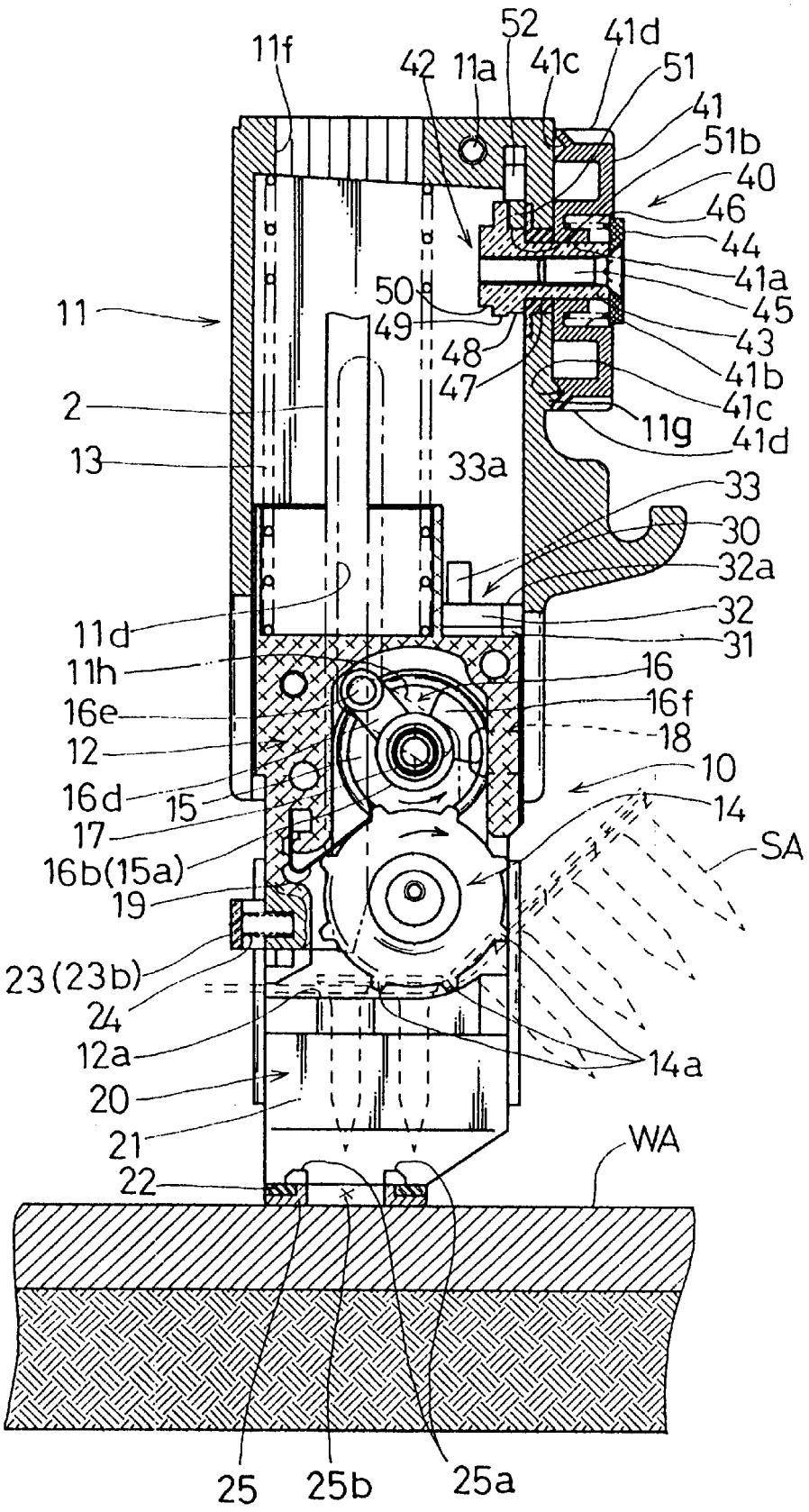
FIG. 11 is a vertical sectional view of the screw driving device showing the operation when a tool body is pressed downwardly to some extent and showing the operation adapted for driving an A-type screw with the stopper base positioned in the lower position and with the shifter pin positioned in the first position.
Figure 12:
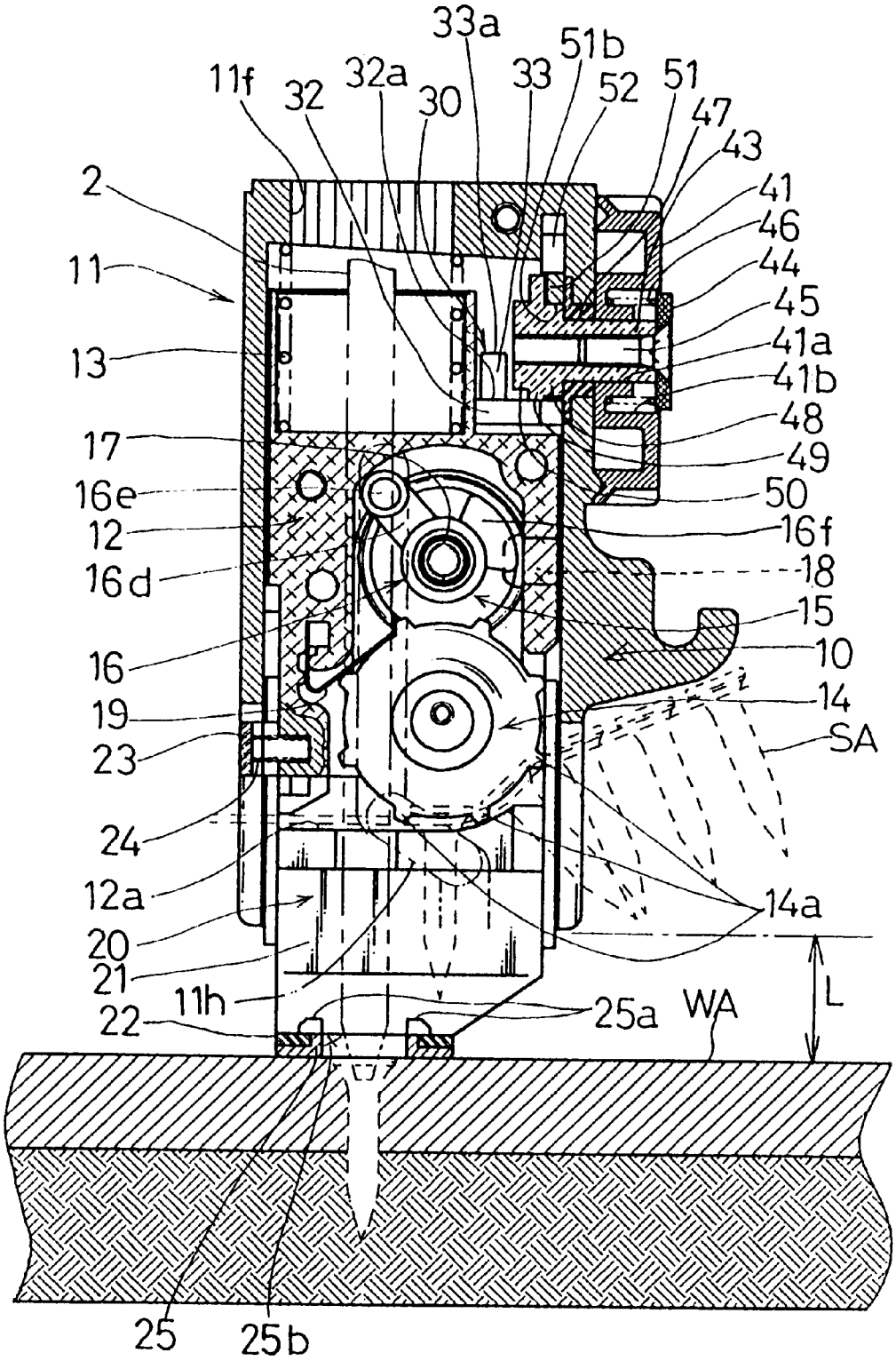
FIG. 12 is a view similar to FIG. 11 but showing the state where the tool body has been lowered to its lowermost position.
Figure 13:
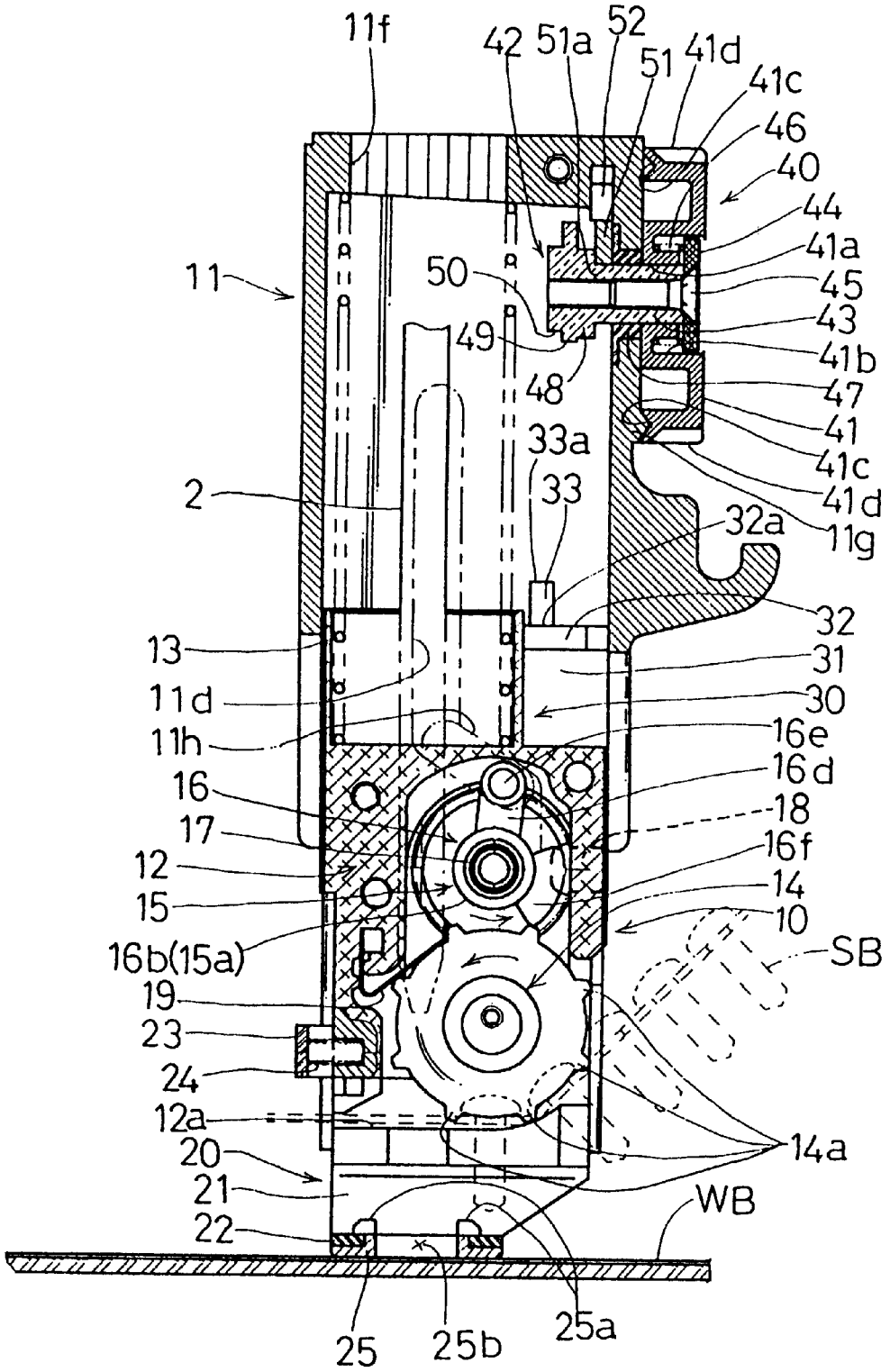
FIG. 13 is a vertical sectional view of the screw driving device showing the operation when the tool body is not pressed downwardly and the operation adapted for driving a B-type screw with the stopper base positioned in the uppermost position and with the shifter pin positioned in the second position.
Figure 14:
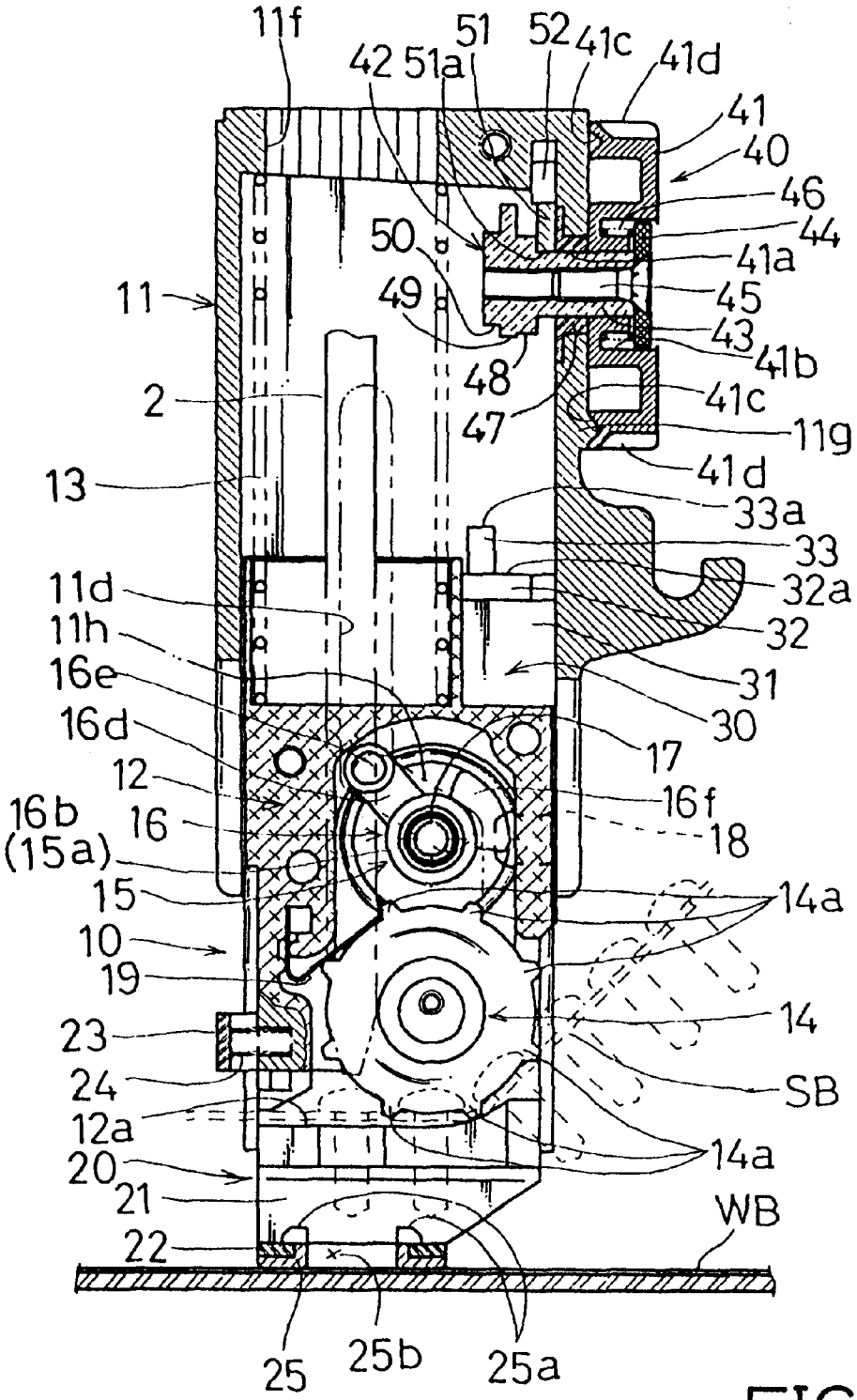
FIG. 14 is a view similar to FIG. 13 but showing the operation when the tool body has been pressed downwardly to some extent to pivot a ratchet arm by a predetermined angle.
Figure 15:
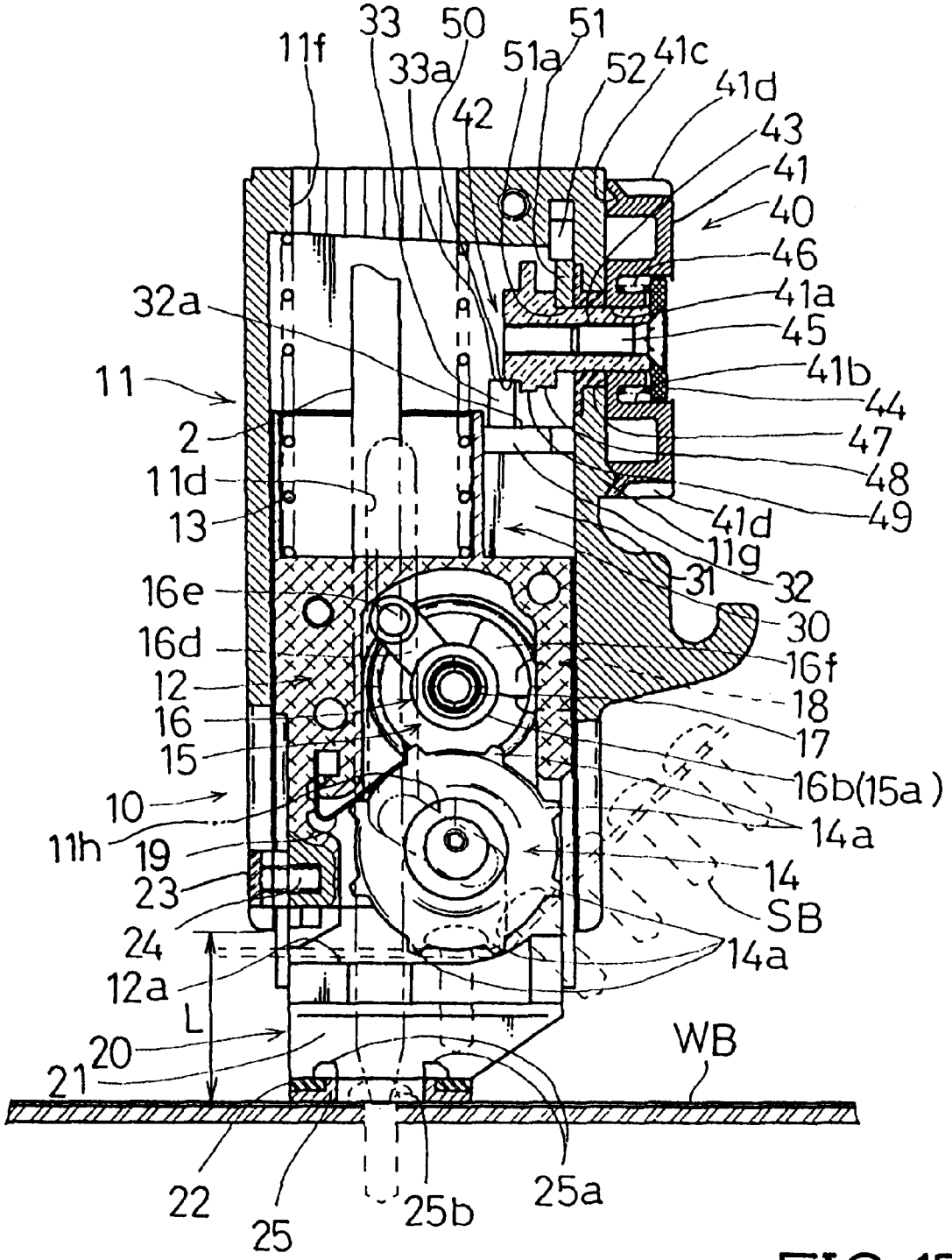
FIG. 15 is a view similar to FIG. 13 but showing the operation when the tool body has been pressed downwardly to its lowermost position to completely drive the screw.

The operation of the screw feeding device 10 will now be explained with reference to FIGS. 1 and 11 to 15. FIGS. 1, 11 and 12 show the operation when the screw feeding device 10 is applied to the screw carrying belt S carrying screws (hereinafter called "A-type screws") which are adapted to be driven into a work W(WA) until upper surfaces of their heads are positioned substantially flush with the upper surface of the work W(WA). FIGS. 13 to 15 show the operation when the screw feeding device 10 is applied to the screw carrying belt S carrying screws (hereinafter called "B-type screws SB") which are adapted to be driven into a work W(WB) until lower surfaces of their heads abut on the upper surface of the work W(WB). The operations of the screw feeding device 10 for feeding the screw carrying belt S carrying the A-type screws SA and that carrying the B-type screws SB are performed in the same manner. Therefore, the operation will be described only in connection with the feeding operation of the screw carrying belt S carrying the A-type screws SA with reference to FIGS. 1, 11 and 12.

In the drawings, the work WA and WB are adapted for driving the A-type screws SA and the B-type screws SB, respectively. A stopper base 20 is mounted on the feeder box 12, and a stopper mechanism 40 is provided for limiting the upper stroke end of the feeder box 12. The stopper base 20 and the stopper mechanism 40 will be explained later.

FIG. 1 shows the situation where the stopper base 20 is in abutment on the work WA without any pressing force applied thereto and where the screw feeding device 10 is in an inoperative position. In the inoperative position, the head of the bolt 12*b* is in abutment on the bottom of the guide recess 11*b* (see FIG. 3), so that the feeder box 12 is in its lower stroke end and that the guide roller 16*e* is positioned at the lower end of the slant portion 11*h* of the guide recess 11*d*.

When the operator presses the tool body 1 downwardly toward the work WA with the screw feeding device 10 in the inoperative position, the feeder box 12 is moved upwardly relative to and within the casing 11 against the biasing force of the compression spring 13 as shown in FIG. 11. As the feeder box 12 is moved upwardly, the guide roller 16*e* is moved leftwardly as viewed in FIG. 11 along the slant portion 11*h* of the guide recess 11*d*, so that the ratchet arm 16 is pivoted in the feeding direction as indicated by the arrow by the predetermined angle.

As the ratchet arm 16 is thus pivoted, the intermediate gear 15 is rotated by the same angle in the same direction through engagement between the engaging claws 15*b* and 16*c*, so that the ratchet wheel 14 is rotated in the feeding direction to feed the screw carrying belt S by the distance of one pitch of the screws SA. By such a movement of the screw carrying belt S, one of the screws SA is set to be positioned directly below the driver bit 2 as shown in FIG. 11.

As the operator further presses the tool body 1 downwardly, the feeder box 12 is further moved upwardly relative to the casing 11 and the lower end of the driver bit 2 is brought to abut on the head of the screw SA. At this stage, the guide roller 16*e* has been moved from the slant portion 11*h* to a vertical linear portion of the guide recess 11*d*, so that the ratchet arm 16 may not be rotated and that the ratchet wheel 14 is held in a position which is taken when the screw carrying belt S has been moved by the distance of one pitch of the screws SA.

As the operator still further presses the tool body 1 with the driver bit 2 in abutment on the head of the screw SA, the driver bit 2 is started to be rotated and the screw SA is removed from the screw carrying belt S. At substantially the same time with the removal of the screw SA, the lower end of the screw SA is brought to abut on the work WA and the screw SA is then driven into the work WA. The situation where the screw SA has been completely driven into the work WA is shown in FIG. 12.

When the screw SA has been completely driven, a stroke converting member 30 provided on the feeder box 12 is brought to abut on a cam 49 (or a cam 50) of the stopper mechanism 40, so that the feeder box 12 reaches its upper stroke end. This means that the tool body 1 as well as the casing 11 reaches its lower stroke end. At this stage, the lower end of the casing 11 is spaced from the work WA by a distance L.

After completion of the screw driving operation, the operator releases the pressing force applied to the tool body 1, so that the feeder box 12 is moved downwardly relative to the casing 11. As the feeder box 12 is thus moved downwardly, the ratchet arm 16 is pivoted by the predetermined angle in the direction opposite to the feeding direction through the movement of the guide roller 16*e* along the slant portion 11*h* of the guide recess 11*d* from the position shown in FIG. 11 to the position shown in FIG. 1. At this stage, however, the intermediate gear 15 is prevented from rotating in the direction opposite to the feeding direction by the leaf spring 19. Therefore, the ratchet arm 16 is moved axially against the biasing force of the compression spring 17 as it is pivoted in the direction opposite to the feeding direction, so that the engaging claws 16*c* and 15*b* are disengaged from each other, and that the ratchet arm 16 is pivoted in the direction opposite to the feeding direction or the reverse direction by the predetermined angle corresponding to one pitch of the screws SA. When the ratchet arm 16 has been thus pivoted in the reverse direction, the guide roller 16*e* is positioned at the lower end of the slant portion 11*h*, and the head 12*b* of the bolt 12*d* is in abutment on the bottom of the guide recess 11*b*, so that the feeder box 12 is in its lower stroke end. One cycle of the screw driving operation is thus completed.

Figure 27:
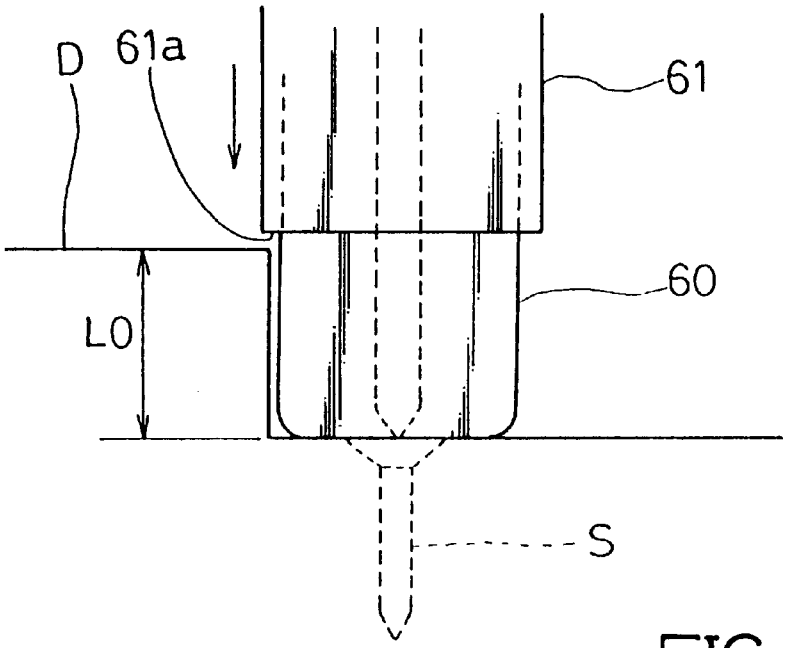
FIG. 27 PRIOR ART
FIG. 27 is a view showing the positional relationship between a stepped portion of a work and a lower end of a casing of the conventional screw driving device.

With the screw feeding device 10 thus constructed, the distance L can be provided between the lower end of the casing 11 and the work WA when the casing 11 is in its lower stroke end after completion of the driving operation. The distance L is determined to be greater than the height L0 of the stepped portion D (see FIG. 27), so that the casing 11 may not abut on the stepped portion D or may not cause damage thereto even if the screw SA is to be driven into the work in a position adjacent the stepped portion D.

Figure 28:
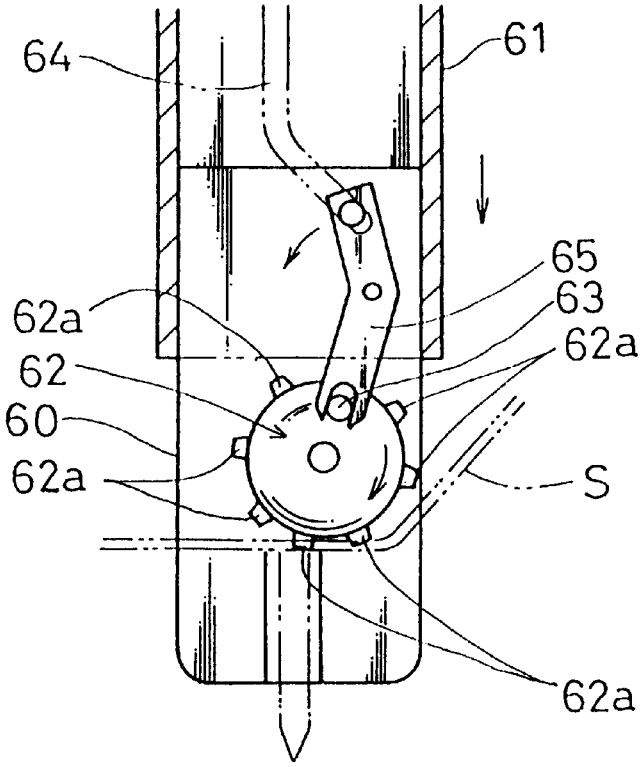
FIG. 28 PRIOR ART
FIG. 28 is a vertical sectional view of the essential parts of the conventional screw driving device.

In addition, with this embodiment, the intermediate gear 15 is interposed between the ratchet arm 16 and the ratchet wheel 14, and by means of the intermediate gear 15, the ratchet wheel 14 is rotated by the predetermined angle in the feeding direction to feed the screw carrying belt S by the distance of one pitch of the screws SA. Therefore, this embodiment does not require any member corresponding to the feeding pin 63 (see FIG. 28) provided in the conventional screw feeding device. As described in the description of the prior art, in the conventional device, the wear produced during transmission of rotation is concentrated upon one feeding pin 63 since this pin 63 is always in engagement with one end of the feeding arm 65. Therefore, one end of the feeding arm 65 as well as the feeding pin 63 may be easily worn, resulting in that the durability of the feeding device is remarkably degraded.

In contrast, with the screw feeding device 10 of this embodiment, the pivotal movement of the ratchet arm 16 is transmitted to the ratchet wheel 14 through engagement of teeth of the intermediate gear 15 and teeth of the gear part 14*b* of the ratchet wheel 14. Therefore, any wear which may be produced during the transmission can be dispersed to all the teeth of the intermediate gear 15 and to all the teeth of the gear part 14*b* of the ratchet wheel 14. Therefore, the durability of the screw feeding device 10 may be significantly improved.

In addition, the intermediate gear 15 is positioned deeper into the feeder box 12 than the ratchet wheel 14, and the ratchet wheel 14 as well as the intermediate gear 15 is permitted to be rotated in the direction opposite to the feeding direction when the engagement of the ratchet arm 16 with the intermediate gear 15 is released. Therefore, the releasing portion 16*f* and the releasing button 18 for disengagement between the intermediate gear 15 and the ratchet arm 16 may be disposed as deep as possible into the feeder box 12.

In contrast, with the prior art arrangement as disclosed in Japanese Laid-Open Patent Publication Nos. 3-49879 and 4-111781, an engaging member is adapted to directly engage the ratchet wheel for preventing the ratchet wheel from rotating in a direction opposite to a feeding direction. The engaging member is operable to permit rotation of the ratchet wheel in the direction opposite to the feeding direction and to permit withdrawal of a screw carrying belt in the same direction. For this reason, an operation member such as a lever for operation of the engaging member is disposed in a position adjacent the ratchet wheel. The place about the ratchet wheel includes many parts which are exposed to the outside because of the construction and the function of the ratchet wheel. Therefore, dusts and foreign materials may easily enter the place about the ratchet wheel, and the prior arrangement involves the problem that the operation member for the engaging member may not be reliably operated.

With the above embodiment of the present invention, the permission of rotation of the ratchet wheel 14 in the direction opposite to the feeding direction is not given by the operation of the engaging member which is directly engaged with the ratchet wheel as in the prior art. Thus, the rotation is permitted indirectly through disengagement between the ratchet arm 16 and the intermediate gear 15 which are disposed deeper into the feeder box 12 than the ratchet wheel 14. Therefore, the releasing portion 16*f* and the releasing button 18 can be disposed in a position which is deeper into the feeding box 12 than the ratchet wheel 14, so that the chance of entrance of dusts and foreign materials may be reduced, and that the releasing button 18 has less chance to cause unreliable operation. In other respect, as shown in FIG. 1, the stopper base 20 of the screw feeding device 10 of this embodiment is adapted to abut on the work W and is operable to convert the distance between the screw carrying belt S and the work W so as to cope with change of screws SA to those having different lengths.

The stopper base 20 is shown in FIGS. 7(A) to 7(D) and has a substantial U-shaped configuration including a pair of vertical members 21 and a transverse member 22 connected between the lower ends of the vertical members 21. The stopper base 20 is mounted on the feeder box 12 such that the stopper base 20 extends between both bifurcated lower portions of the feeder box 12. Each of the vertical members 21 has a pair of retainer walls 21*a* formed on both sides thereof and bent perpendicular to the corresponding vertical member 21 in an L-shaped manner. Each of the retainer walls 21 has an upper end formed with a guide edge 21*b* which is bent inwardly perpendicular to the corresponding retainer wall 21 also in an L-shaped manner.

Figures 7A, 7B, 7C, 7D:
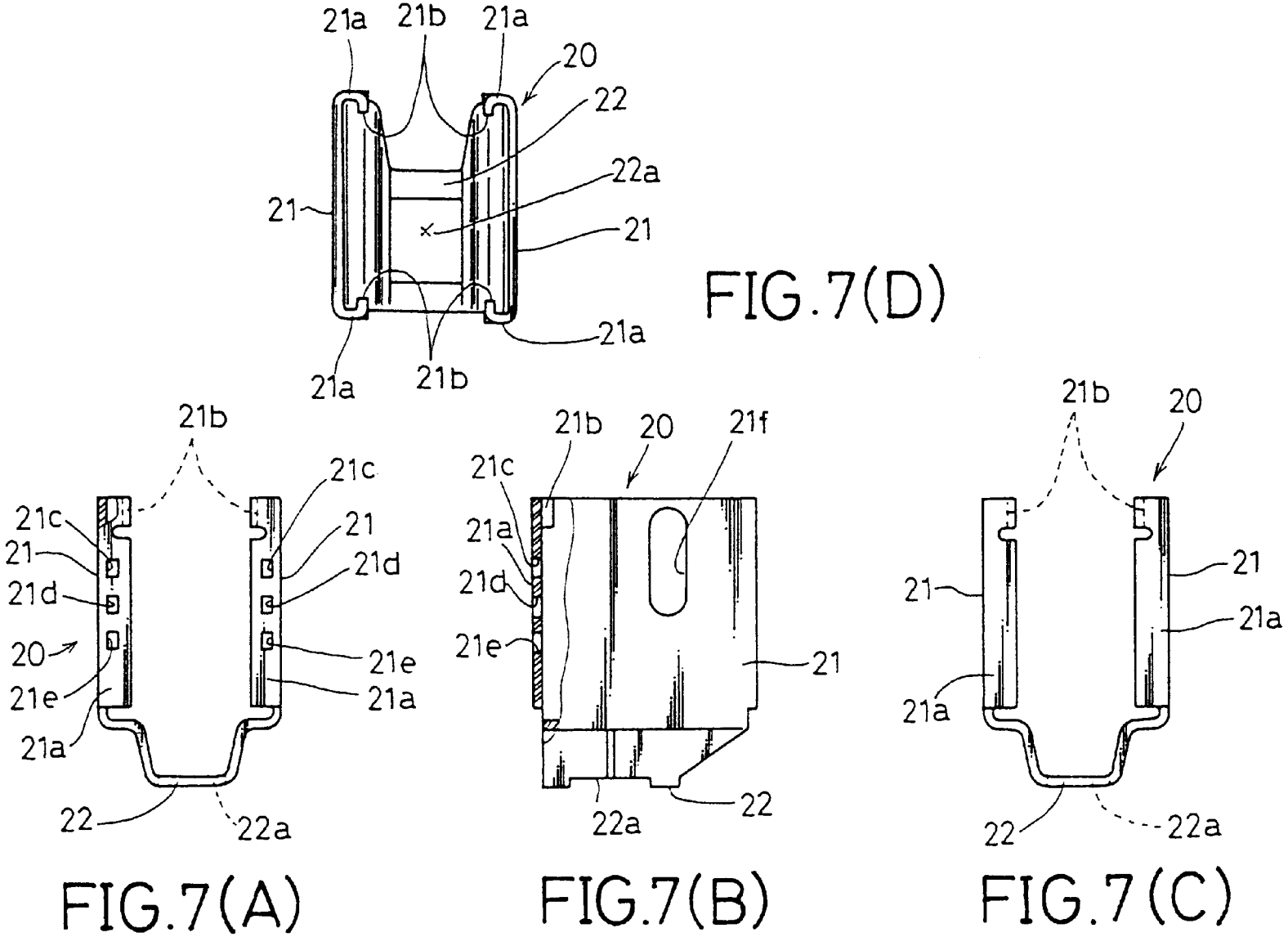
FIGS. 7(A) to 7(D) are a front view, a side view, a rear view and a plan view of the stopper base, respectively.

As shown in FIG. 7(A), each of the retainer walls 21*a* positioned on the front side has three lock holes or an upper lock hole 21*c*, a middle lock hole 21*d* and a lower lock hole 21*e* arranged in series in the vertical direction and are spaced from each other by a predetermined distance. As shown in FIG. 7(B), one of the vertical members 21 has a vertically elongated support hole 21*f* formed therein.

The transverse member 22 is adapted to be pressed on the work W during the driving operation. As shown in FIG. 7(D), a rectangular hole 22*a* is formed in the central portion of the transverse member 22. The screw SA(SB) is driven into the work S though the rectangular hole 22*a*.

Figure 6:
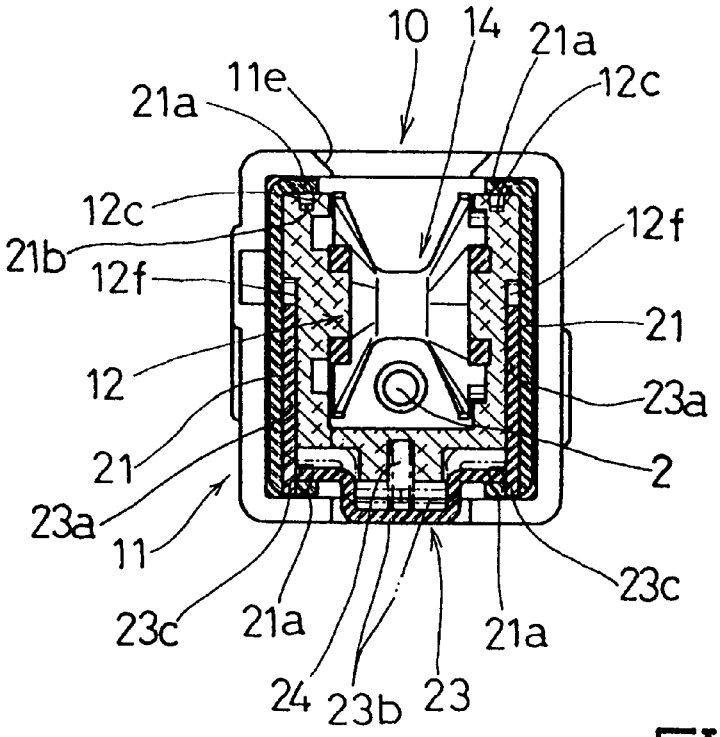
FIG. 6 is a sectional view taken along line VI—VI in FIG. 4.

On the other hand, as shown in FIGS. 3 and 6, a pair of parallel guide recesses 12*c* are formed in both front and rear surfaces (upper and lower surfaces as viewed in FIG. 6) of the feeder box 12 and arc positioned adjacent their lateral edges. Each of the guide recesses 12*c* extends from the lower end of the feeder box 12 to a position substantially the same level as the support shaft 16*a* of the ratchet arm 16. The stopper base 20 is vertically slidably mounted on the feeder box 12 by inserting the guide edges 21*b* of the retainer walls 21*a* into their corresponding guide recesses 12*c* from their open lower ends. As shown in FIG. 6, the vertical members 21 and the retainer walls 21*a* slidably contact their corresponding outer surfaces of the feeder box 12 in such a manner that they partly surrounds the feeder box 12, so that the stopper base 20 in the mounted state does not show looseness in the horizontal direction.

As shown in FIGS. 2 and 4, a fixing screw 12*e* is screwed into the rear surface of the feeder box 12 through the support hole 21*f* formed in the stopper base 20, so that the stopper base 20 is permitted to be moved vertically within a movable range of a head of the fixing screw 12*c* relative to the support hole 21*f*. The fixing screw 12*e* also serves to prevent removal of the stopper base 20 from the feeder box 12.

Figure 8B:
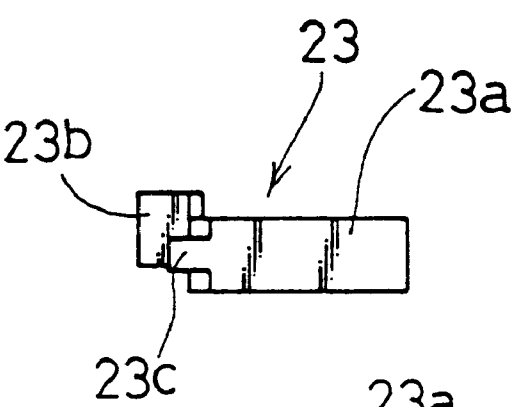
FIGS. 8(A) to 8(C) are a front view, a side view and a plan view of a lock lever, respectively.
Figure 8C:
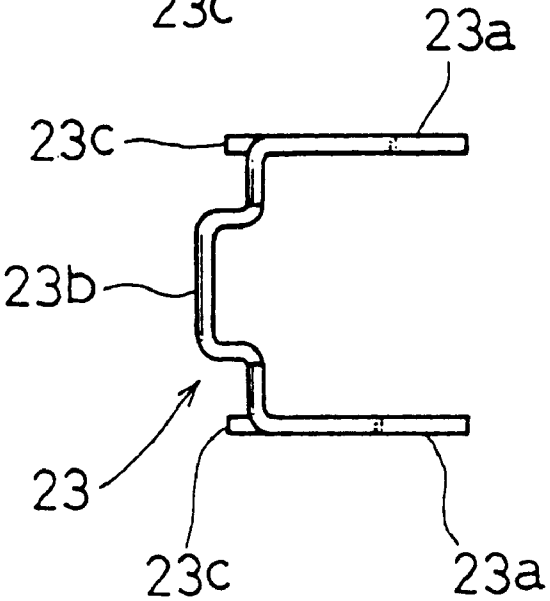
Figure 8A:
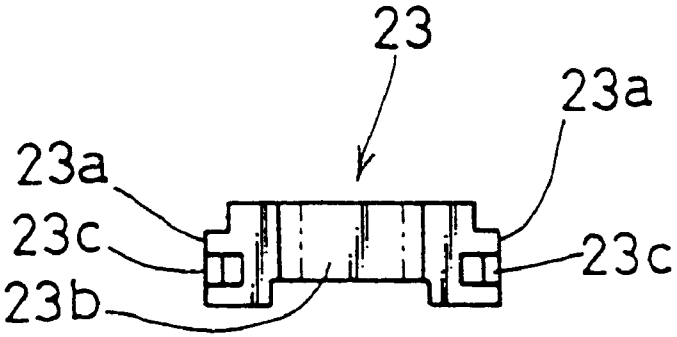

A lock lever 23 for fixing the vertical position of the stopper base 20 is shown in FIG. 6. FIGS. 8(A) to 8(C) show various views of the lock lever 23. The lock lever 23 has a substantially U-shaped configuration and includes a pair of leg members 23*a* and a transverse member 23*b* connected between the leg members 23*a*. At each of the corner portions between the leg members 23*a* and the transverse member 23*b*, a lock protrusion 23*c* protrudes forwardly from the front end of the corresponding leg member 23*a*. The lock protrusion 23*c* is formed by providing a slit in the transverse member 23*b* and bending a part of the transverse member 23*b* surrounded by the slit.

As shown in FIGS. 4 and 6, a pair of retainer recesses 12*f* are formed on both right and left surfaces of the feeder box 12 as viewed in FIG. 6 and extends horizontally from the front surface (lower surface as viewed in FIG. 6) toward the rear surface (upper surface as viewed in FIG. 6) of the feeder box 12. The leg members 23*a* of the lock lever 23 are inserted into their corresponding retainer recesses 12*f* from the open front ends of the retainer recesses 12*f*, so that the lock lever 23 is slidably movable in forward and rearward directions (vertical direction as viewed in FIG. 6) relative to the feeder box 12. As shown in FIGS. 4 and 6, in the mounting state, the leg members 23*a* are positioned between the stopper base 20 and the feeder box 12, and the lock protrusions 23*c* are oriented toward their corresponding lock holes 21*c*, 21*d* and 21*e* from the inside of the stopper base 20.

As shown in FIGS. 1 and 6, a compression spring 24 is interposed between the transverse member 23*b* of the lock lever 23 and the front surface of the feeder box 12, so that the lock lever 23 is normally biased in a direction (downward direction as viewed in FIG. 6) for inserting its lock protrusions 23*c* into the lock holes 21*c* (or 21*d*, 21*e*).

A cap 25 (not shown in FIGS. 7(A) to 7(D)) made of resilient material is mounted on the lower surface of the transverse member 22 of the stopper base 20. The cap 25 has a central portion which is fitted into the rectangular hole 22*a* of the transverse member 22 and which has protrusions 25*a* for engagement with peripheral edge of the rectangular hole 22*a*. The central portion of the cap 25 includes a rectangular hole 25*b* which is in alignment with the rectangular hole 22*a* and which is slightly smaller than the same.

With the stopper base 20 thus constructed, when the operator pushes the transverse member 23*b* of the lock lever 23 against the biasing force of the compression spring 24, the lock protrusions 23*c* are removed from the lock holes 21*c* (or 21*d*, 21*c*), so that the stopper base 20 can be moved vertically relative to the feeder box 12. The movable range of the stopper base 20 is limited by the fixing screw 12*e* having its head positioned within the support hole 21*f* as described above.

When the operator releases the transverse member 23*b* with the stopper base 20 positioned at a lowermost position indicated by chain lines in FIGS. 2 and 4, the lock lever 23 returns to bring their lock protrusions 23*c* into the lock holes 21*c*, so that the stopper base 20 is fixed in the lowermost position relative to the feeder box 12. This lowermost position is adapted when the screws SA(SB) are those having a long length.

In the same manner, when the operator releases the transverse member 23*b* with the stopper base 20 positioned at a middle position, the lock protrusions 23*c* are brought to be inserted into the lock holes 21*d*, so that the stopper base 20 is fixed in the middle position. When the operator releases the transverse member 23*b* with the stopper base 20 positioned at an uppermost position, the lock protrusions 23*c* are brought to be inserted into the lock holes 21*c*, so that the stopper base 20 is fixed in the uppermost position. The intermediate position and the uppermost position arc adapted when the screws SA(SB) are those having a middle length and a short length, respectively.

As described above, the position of the stopper base 20 can be adjusted in three different positions in the vertical direction in response to the length of the screws to be driven. Since such adjustment can be performed by pushing the lock lever 23 to remove the lock protrusions 23*c* from the lock holes 21*c* (or 21*d*, 21*e*) and by releasing the lock lever 23, the operator can adjust the position of the stopper base 20 in response to the length of the screws to be driven at any time and at any place without using a special tool such as a screwdriver. Therefore, the screw feeding device 10 is excellent in operability. In addition, since the stopper base 20 is not required to be changed to that having a different size as required in the conventional device, there is no possibility that the stopper base 20 is lost.

Thus, with the conventional screw driving device disclosed in Japanese Laid-Open Patent Publication No. 6-114751, a plurality of stopper bases are prepared for different lengths of screws to be driven and can be selectively mounted on a feeder box without using any tool. However, this device involves the problem that there is some possibility that the stopper bases which are not used are lost. To this end, this publication proposes another embodiment in which a stopper base is mounted on a lower end of a screw driving device and is adjustable in its position by means of fixing screws. With this construction, the device can cope with various lengths of screws to be driven. However, this construction still involves the problem that a tool is required for tightening and loosening the fixing screws.

As described above, the conventional screw driving tools are advantageous in one aspect but are disadvantageous in other aspect. There has never been provided a screw feeding device which does not require to change a stopper base and which does not require any tool to cope with change in lengths of screws.

In contrast, with the screw feeding device 10 of this embodiment, the mounting position of the stopper base 20 can be easily changed without using any tool in response to the length of the screws to be driven, and the stopper base 20 is not required to be removed.

The mechanism for limiting the upper stroke end of the feeder box 12 or the lower stroke end of the casing 11 or the lower stroke end of the tool body 1 to be pressed downwardly will now be explained.

As shown in FIGS. 1 and 4, a stroke converting member 30 is interposed between the feeder box 12 and the casing 11. The stroke converting member 30 has a substantially L-shaped configuration and includes a vertical part 31 and a horizontal part 32 connected thereto. A conversion part 33 is formed on the horizontal part 32 and extends upwardly therefrom The upper surface of the horizontal part 32 other than the conversion part 33 serves as a first stopper surface 32*a* and the upper surface of the conversion part 33 serves as a second stopper surface 33*a*.

The vertical part 31 of the converting member 30 thus constructed is positioned between the feeder box 12 and the casing 11. The lower end of the vertical part 31 is rested on the upper end of the stopper base 20, so that the converting member 30 is vertically movable with the feeder box 12 while the vertical position of the converting member 30 is automatically changed as the vertical position of the stopper base 20 is changed among the uppermost, middle and lowermost positions As shown in FIGS. 1, 11 and 12 or FIG. 4, when the stopper base 20 is in the lowermost position as indicated by chain lines, the converting member 30 is in its lowermost position relative to the feeder box 12. When the stopper base 20 is in the uppermost position as indicated by solid lines in FIGS. 13 to 15 or FIG. 4, the converting member 30 is in its uppermost position relative to the feeder box 12. Thus, as the position of the stopper base 20 is changed, the position of the stroke converting member 30 is changed, so that the upper stroke end of the feeder box 12 relative to the casing 11 can be changed at three different positions. In addition, the upper stroke end of the feeder box 12 relative to the casing 11 can be changed by selectively adapting the first stopper surface 32*a* or 33*b* for limiting the upper stroke end.

As shown in FIG. 1, the stopper mechanism 40 is positioned above the converting member 30 and is operable to perform two different functions. One of the functions is to convert the position of the upper stroke end of the feeder box 12 by two steps by selectively effectuating one of the first and second stopper surfaces 32*a* and 33*a* of the stroke converting member 30. The other function is to provide a fine adjustment of the upper stroke end within a predetermined range for both the first and second stopper surfaces 32*a* and 33*a*.

As shown in FIG. 1, a disk-like adjusting knob 41 is rotatably mounted on an upper portion of a right side wall of the casing 11 as viewed in FIG. 1 by means of a shaft 43 of a shifter pin 42. The shaft 43 is inserted into a central hole 41*a* formed in the adjusting knob 41. The shaft 43 is axially movable relative to the adjusting knob 41 but is not rotatable relative thereto. Thus, although the shifter pin 42 is axially movable relative to the adjusting knob 41, the shifter pin 42 is rotated together with the adjusting knob 41 when the operator rotates the adjusting knob 41.

A washer 44 is secured to an outer end of the shifter pin 42 by means of a flush head screw 45. An annular recess 41*b* is formed in the adjusting knob 41 and has an open end confronting the washer 44. A compression spring 46 is interposed between the bottom of the annular recess 41*b* and the washer 44, so that the adjusting knob 41 is normally biased to abut on the side wall of the casing 11, while the shifter pin 42 is biased in such a direction that the outer end of the shaft 43 extends outwardly (rightwardly as viewed in FIG. 1) from the central hole 41*a* of the adjusting knob 41.

Figure 9:
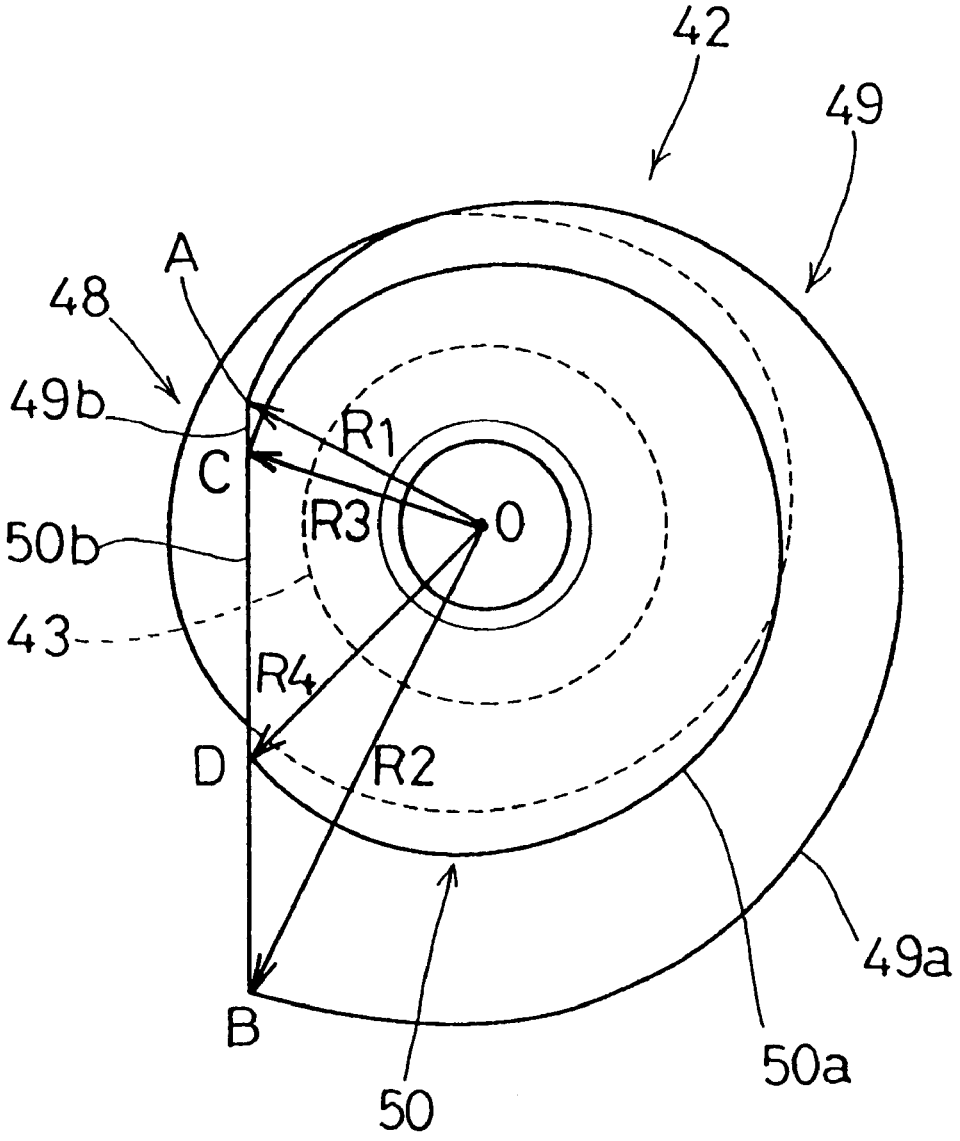
FIG. 9 is a view of a shifter pin in a direction of an arrow IX in FIG. 1 or a direction as viewed from the side of a second cam.

A projection 11*g* is formed on the side surface of the casing 11 in a position confronting the periphery of the rear surface of the adjusting knob 41 which includes a plurality of conical depressions 41*c* arranged in the circumferential direction, so that the adjusting knob 41 can be held in the adjusted position and that an excellent operation feeling (click feeling) can be given to the operator when he rotates the adjusting knob 41. A plurality of fin- like protrusions 41*d* are formed on the outer periphery of the adjusting knob 41 and serve to prevent slippage of fingers of the operator when he rotates the adjusting knob 41. The shifter pin 42 has an inner end which extends into the interior of the casing 11 through a bearing 47. The inner end of the shifter pin 42 has a flange 48, a first cam 49 and a second cam 50 which are formed integrally with the shifter pin 42. The flange 48, the first cam 49 and the second cam 50 are overlapped with each other in this sequence, and the second cam 50 is positioned at the innermost position among them. As shown in FIG. 9, the flange 48 has a circular configuration coaxial with the shaft 43 but has a greater diameter than the shaft 43. The first cam 49 has a curved surface part 49*a* and a straight surface part 49*b*. The distance from a center 0 of the shaft 43 to the curved surface part 49*a* increases gradually from a minimum distance R1 at a beginning point A to a maximum distance R2 at an end point B.

The second cam 50 also includes a curved surface part 50*a* and a straight surface part 50*b* which extends in the same plane as the straight surface part 49*b* of the first cam 49. Similar to the curved surface part 49*a* of the first cam 49, the distance from the center 0 of the shaft 43 to the curved surface part 50*a* increases gradually from a minimum distance R3 at a beginning point C to a maximum distance R4 at an end point D. The distances R1 to R4 are determined to have the relationship "R2−R1>R4−R3". Thus, the rate of change in diameter of the curved surface part 49*a* of the first cam 49 is greater than that of the curved surface part 50*a* of the second cam 50 (the curvature of the curved surface part 49*a* is gentle than that of the curved surface part 50*a*). This means that the first cam 49 provides relatively low adjusting accuracy of the upper stroke end but provides a greater adjustable range of the same while the second cam 50 provides a relatively narrow adjustable range but provides high adjusting accuracy.

The first and second stopper surfaces 32*a* and 33*a* of the stroke converting member 30 can be selectively effectuated by shifting the shifter pin 42 in the axial direction. FIGS. 1, 11 and 12 show the state where the shifter pin 42 is in a first position on the right side.

With the shifter pin 42 in the first position, the first cam 49 of the shifter pin 42 is brought to abut on the first stopper surface 32*a* of the stroke converting member 30 when the feeder box 12 is moved upwardly relative to the casing 11 as shown in FIG. 12.

Figure 10A:
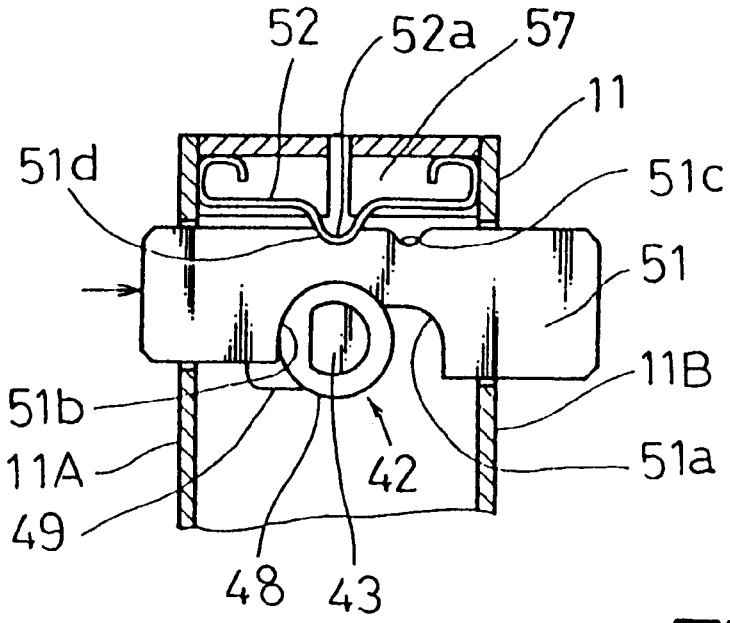
FIGS. 10(A) and 10(B) are views showing a switching plate in right and left positions for positioning the shifter pin in first and second positions, respectively.
Figure 10B:
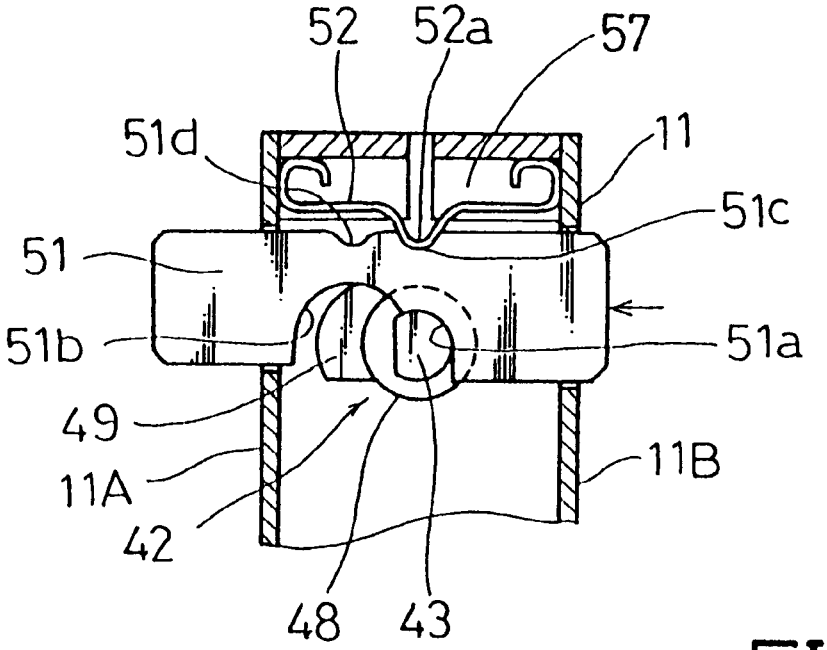

In order to shift the shifter pin 42 from the first position to the second position on the left side as shown in FIGS. 13 to 15, the operator pushes the washer 44 into the central hole 41*b* of the adjusting knob 41. With the shifter pin 42 in the second position, the second cam 50 is brought to abut on the second stopper surface 33*a* of the stroke converting member 30 as shown in FIG. 15. A switching plate 51 is provided for selectively fixing the shifter pin 42 between the first position and the second position. As shown in FIGS. 10(A) and 10(B), the switching plate 51 is slidably movably supported between the lateral wall 11A and the lateral wall 11B confronting thereto in a position above the shifter pin 42. The switching plate 51 has both ends extending outwardly from the lateral walls 11A and 11B, respectively.

As shown in FIGS. 10(A) and 10(B), a small slot 51*a* and a large slot 51*b* each having a substantially semi-circular configuration are formed in the switching plate 51 on its lower side and substantially centrally of the switching plate 51 in its longitudinal direction. The small slot 51*a* and the large slot 51*b* are formed in series with each other and are positioned on the right side and the left side, respectively, as viewed in FIGS. 10(A) and 10(B). The small slot 51*a* has a diameter to permit insertion of the shaft 43 of the shifter pin 42 while the large slot 51*b* has a diameter to permit insertion of the flange 48. The flange 48 has a diameter greater than the diameter of the shaft 48, so that the flange 48 may not pass through the small slot 51*a*. V-shaped recesses 51*c* and 51*d* are formed in the switching plate 51 on its upper side and are adapted to engage a protrusion 52*a* of a leaf spring 52. The V-shaped recesses 51*c* and 51*d* are spaced from each other by a distance equal to the distance between the centers of the small slot 51*a* and the large slot 51*b*.

The leaf spring 52 is fitted between the lateral walls 11A and 11B of the casing 11 and is fixed in position relative to the casing 11 with its protrusion 52*a* oriented downwardly toward the switching plate 51. The switching plate 51 can be held in any of right and left positions through engagement of the protrusion 52*a* with one of the V-shaped recesses 51*c* and 51*d*.

When the switching plate 51 is shifted from the left position to the right position as shown in FIG. 10(A), the large slot 51*b* is brought to confront the shifter pin 42. Since the flange 48 can pass through the large slot 51*b*, the shifter pin 42 returns to the first position by the force of the compression spring 46.

In order to shift the shifter pin 42 to the second position, the operator pushes the washer 44 into the central hole 41*b* against the biasing force of the spring 46. With the shifter pin 42 thus shifted to the second position, the operator moves the switching plate 51 from the right position to the left position as shown in FIG. 10(B), so that the small slot 51*a* is brought to confront the shifter pin 42. Since the flange 48 may not pass through the small slot 51*a*, the shifter pin 42 is prevented from returning to the first position, so that the shifter pin 42 is held in the second position. Thus, a part of the switching plate 51 about the smaller slot 51*a* is positioned between the flange 48 and the front wall of the casing 11 (see FIG. 13) to prevent the shifter pin 42 from moving from the second position to the first position. In contrast, the large slot 51*b* serves as escape means for permitting the flange 48 to pass therethrough.

When the shifter pin 42 is in the first position, the second cam 50 is positioned away from a position above the second stopper surface 33*a* of the stroke converting member 30. On the other hand, when the shifter pin 42 is in the second position, the second cam 50 is positioned above the second stopper surface 33*a*. Therefore, when the shifter pin 42 is held in the second position and when the stroke converting member 30 is moved upwardly with the feeder box 12, the second stopper surface 33*a* is brought to abut on either of the curved surface part 50*a* or the straight surface part 50*b* of the second cam 50. On the other hand, when the shifter pin 42 is returned to the first position by shifting the switching plate 51 rightwardly, the first stopper surface 32*a* is brought to abut on either the curved surface part 49*a* or the straight surface part 49*b* of the first cam 49.

As described above, the first stopper surface 32*a* is effectuated when the shifter pin 42 is in the first position, while the second stopper surface 33*a* is effectuated when the shifter pin 42 is in the second position. The first stopper surface 32*a* and the second stopper surface 33*a* are spaced from each other in the vertical direction by a distance corresponding to the height of the conversion part 33, so that the upper stroke end of the feeder box 12 or the lower stroke end of the tool body 1 can be changed by such a distance. This means that the stroke conversion function is provided.

Since the first and second cams 49 and 50 have curved surface parts 49*a* and 50*a*, respectively, each having a diameter gradually varying in the circumferential direction, the fine adjustment of the upper stroke end of the feeder box 12 can be performed in connection with both the first and second cams 49 and 50 by rotating the adjusting knob 41 at an appropriate angle. This means that the function for fine adjustment of the stroke is provided. In addition, since the rate of change in diameter of the curved surface part 49*a* of the first cam 49 is greater than that of the curved surface part 50*a* of the second cam 50, as described previously, the curved surface part 49*a* of the first cam 49 provides relatively low adjusting accuracy of the upper stroke end but provides a greater adjustable range of the same while the curved surface part 50*a* of the second cam 50 provides a relatively narrow adjustable range but provides high adjusting accuracy.

The stroke conversion operation by shifting the shifter pin 42 between the first and second positions can be performed independently or concurrently with the stroke converting operation performed by changing the position of the stopper base 20. By concurrently performing both the stroke conversion operations, the stroke can be changed within a broadest range (by six steps). FIGS. 1, 11 and 12 show the arrangement for driving the screws SA having a long length. In this arrangement, the stopper base 20 is mounted on the lowermost position, and the shifter pin 42 is shifted to the first position to effectuate the first stopper surface 32*a*, so that the stoke of the feeder box 12 has a greatest value among the six different values.

With regard to the fine adjustment by rotation of the adjusting knob 41, the stroke of the feeder box 12 may have a maximum value when the straight surface part 49*b* is adapted to abut on the first stopper surface 32*a*. The stroke becomes smaller when the operator rotates the adjusting knob 41 to bring the curved surface part 49*a* for abutment on the first stopper surface 32*a*. More specifically, the stroke of the feeder box 12 is gradually decreased as the operator rotates the adjusting knob 41 in a direction from the beginning point A to the end point B, so that the fine adjustment can be performed.

FIGS. 13 to 15 shows the arrangement for driving the screws SB having a short length. In this case, the stopper base 20 is positioned at the uppermost position, and the shifter pin 42 is shifted to the second position for effectuating the second stopper surface 33*a*, so that the stroke of the feeder box 12 has the smallest value among the six different values.

Also in this case, the stroke of the feeder box 12 becomes maximum when the straight surface part 50*b* is adapted to abut on the second stopper surface 33*a*. The stroke becomes smaller when the operator rotates the adjusting knob 41 to bring the curved surface part 50*a* for abutment on the second stopper surface 33*a*. More specifically, the stroke of the feeder box 12 is gradually decreased as the operator rotates the adjusting knob 41 in a direction from the beginning point C to the end point D, so that the fine adjustment can be performed.

With the stopper mechanism 40 of this embodiment, various types of screws (such as screws having different head configurations) can be driven into a work at their suited driving depths by shifting the shifter pin 42 between the first and second positions. In addition, such driving depths can be adjusted more accurately by rotating the adjusting knob 41.

As described above, with this embodiment, by shifting the shifter pin 42 between the first and second positions, the fine adjustment can be performed in two different modes with respect to the adjustable range and the adjusting accuracy.

Figure 16B:
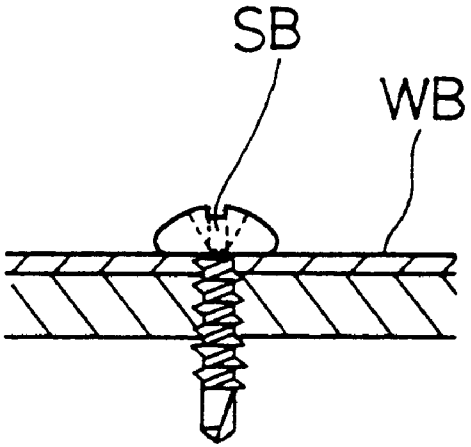
FIGS. 16(A) and 16(B) are views showing the A-type screw and the B-type screw which have been completely driven into works, respectively.
Figure 16A:
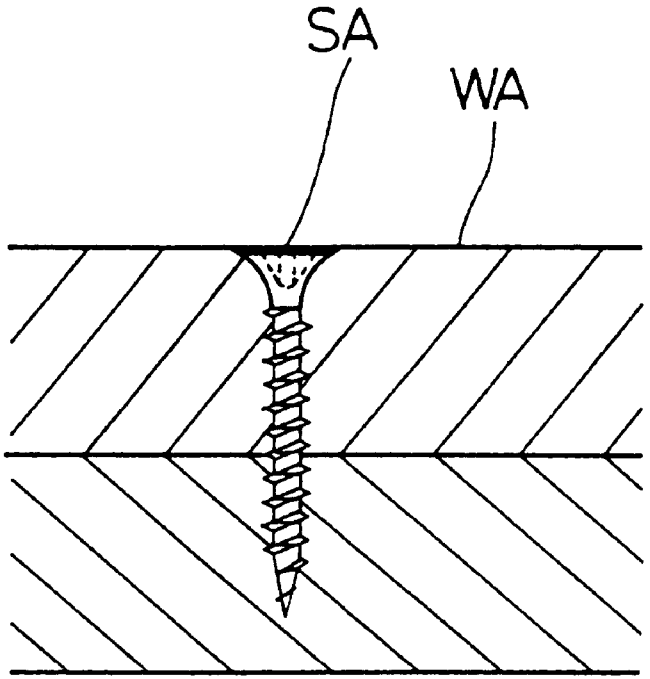

The driving depth may be varied with change in material of the work WA if a screw to be driven is the screw SA such as a drill screw having a flush head which is adapted to be driven into the work WA until the upper surface of the head of the screw SA is brought to be substantially flush with the upper surface of the work WA as shown in FIG. 16(A). Therefore, for driving the screw SA, it is desirable that the tool provides a greater adjustable range rather than a higher adjusting accuracy.

For this reason, when this kind of screw SA is to be driven, it is preferable that the shifter pin 42 is shifted to the first position to enable fine adjustment using the curved surface part 49*b* of the first cam 49, so that the adjustment can be performed with the broader adjustable range although the adjusting accuracy is not high.

On the other hand, if a screw to be driven is the screw SB such as a drill screw having a pan head which is adapted to be driven into the work WB until the lower surface of the head of the screw SB is brought to abut on the upper surface of the work WB as shown in FIG. 16(B), the driving depth must be determined highly accurately in order to cause the lower surface of the head of the screw SB to closely contact the work WB. Thus, if the driving depth cannot be determined accurately, the problem may be caused that the screw SB is insufficiently or excessive driven into the work Therefore, for driving the screw SB, it is desirable that the tool provides a high adjusting accuracy rather than the broader adjustable range.

For this reason, when this kind of screw SB is to be driven, it is preferable that the shifter pin 42 is shifted to the second position to permit fine adjustment using the curved surface part 50*a* of the first cam 50, so that the adjustment can be performed with high adjusting accuracy although the adjustable range is not so broad.

Thus, with the stopper mechanism 40 of this embodiment, in addition to the step-by-step adjustment of the upper stroke end and the sequential fine adjustment thereof, the fine adjustment can be performed in two different modes in response to the kind of the screw (configuration of the head of the screw) to be driven.

In contrast, with the conventional stopper mechanism disclosed in Japanese Laid-Open Patent Publication No. 5-337837, fine adjustment is performed using a single cam. Therefore, adjusting accuracy and adjustable range cannot be varied, resulting in that excessive driving or insufficient driving of the screw may be caused or that it is not possible to obtain a broader adjustable range which is sufficient for practical use.

The above embodiment may be modified in various manners.

For example, although with the stopper mechanism 40 of this embodiment, two cams 49 and 50 are provided, three or more cams can be incorporated to perform suitable fine adjustment for more various kinds of screws.

The lock holes 21*c*, 21*d* and 21*e* may be provided in the feeder box 12 in place of the stopper base 20, with the lock lever 23 provided on the stopper base 20. Although the stopper base 20 can be positioned at three different positions, it may be constructed to be positioned at two or four or more positions as disclosed in a second embodiment which will be described later.

Although the stroke converting member 30 includes two stopper surfaces 32*a* and 33*a*, three or more stopper surfaces may be provided.

In addition, the stroke converting member 30 may be mounted on the casing 11 so as to be moved in response to change in position of the stopper base 20, with the stopper mechanism 40 provided on the feeder box 12.

Further, although in the above embodiment, the ratchet arm 16 and the intermediate gear 15 is disengaged from each other by pushing the releasing button, this embodiment may be modified such that the ratchet arm 16 and the intermediate gear 15 are disengaged from each other by pulling or pivoting a releasing member corresponding to the releasing button 18.

The second embodiment of the present invention will now be explained with reference to FIGS. 17 to 26.

Figure 19:
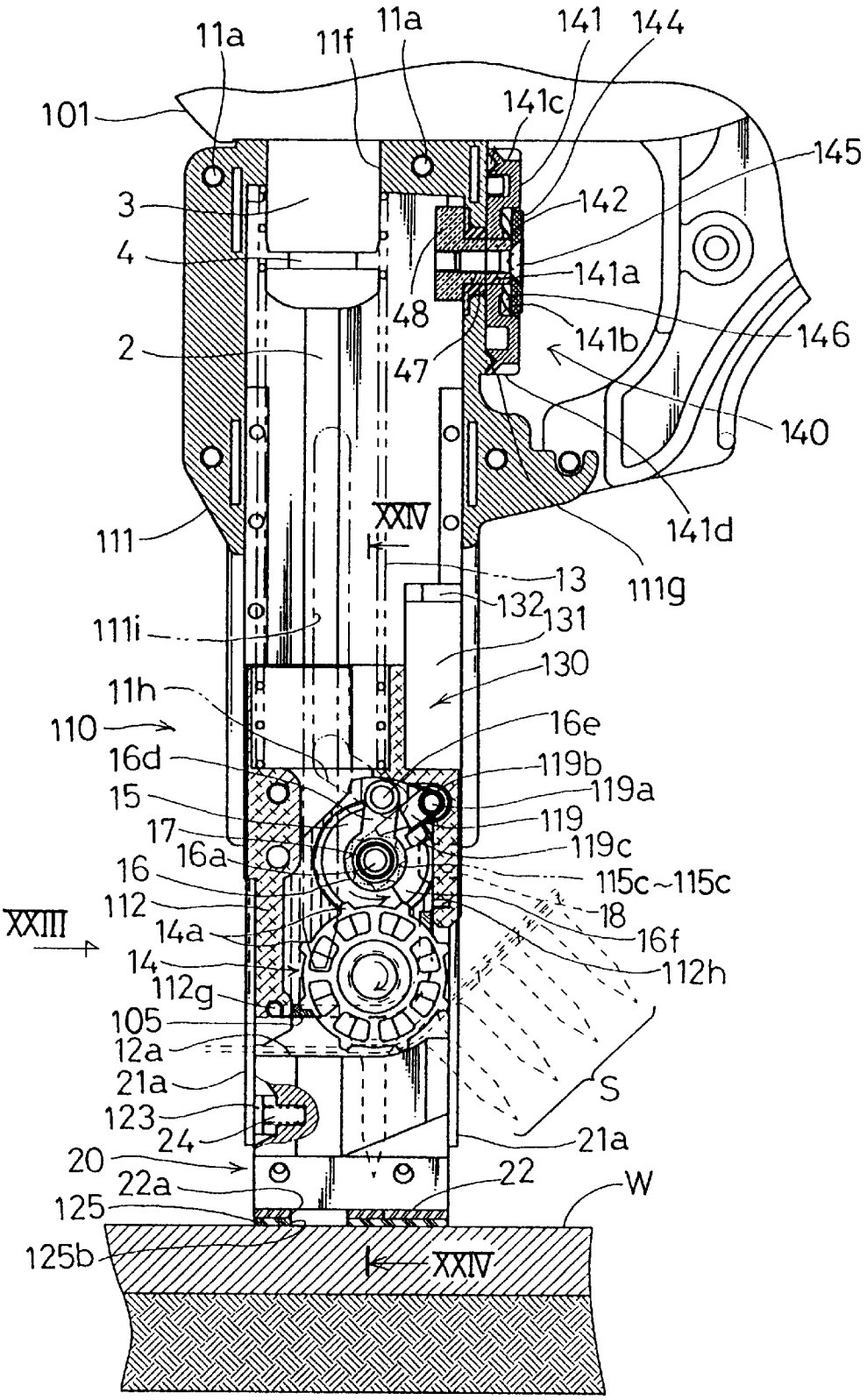
FIG. 19 is a vertical sectional view of the screw feeding device in an inoperative position.
Figure 20:
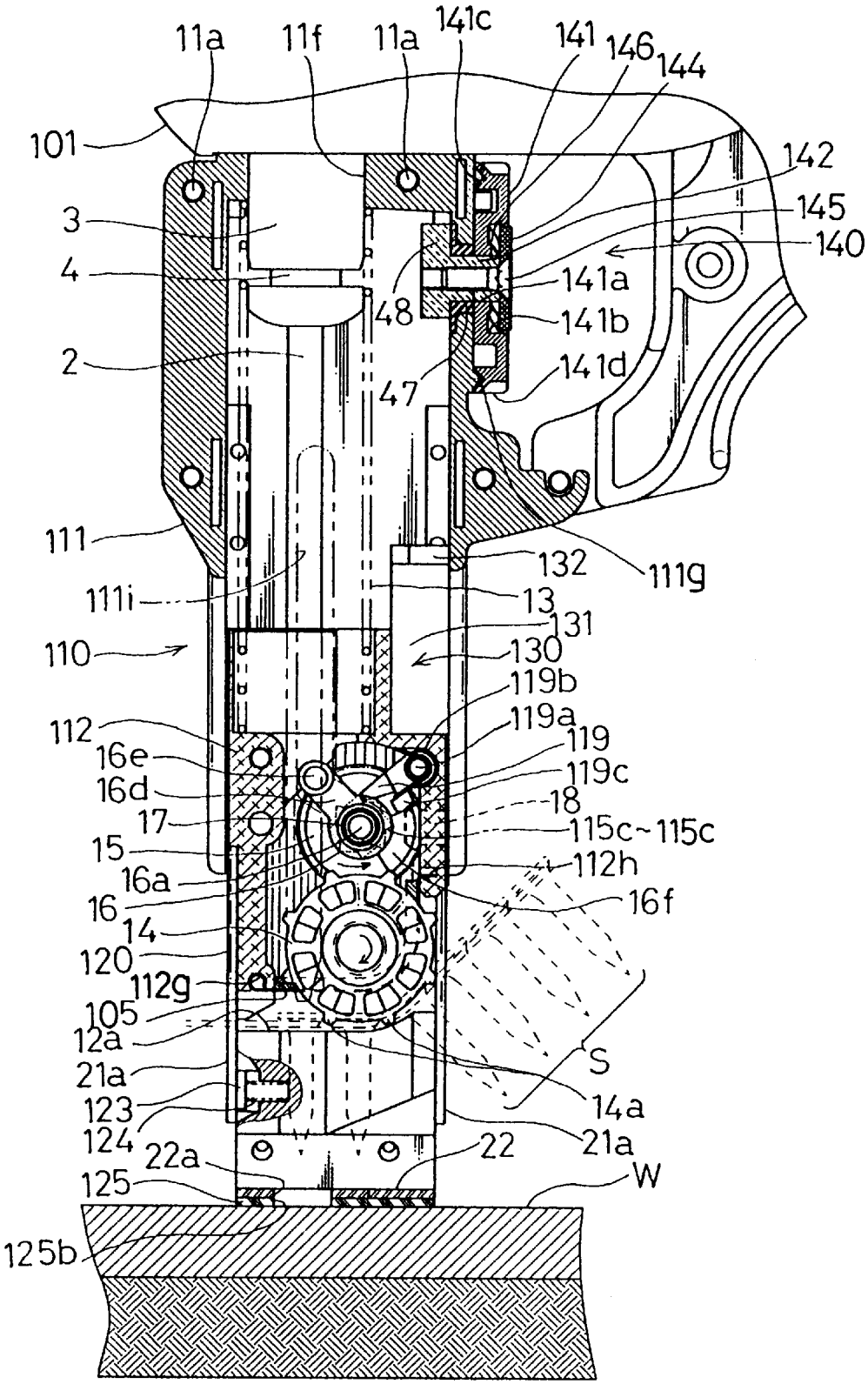
FIG. 20 is a view similar to FIG. 19 but showing the operation when a tool body has been pressed downwardly to feed a screw carrying belt in a position where a screw to be driven is positioned below a driver bit.
Figure 21:
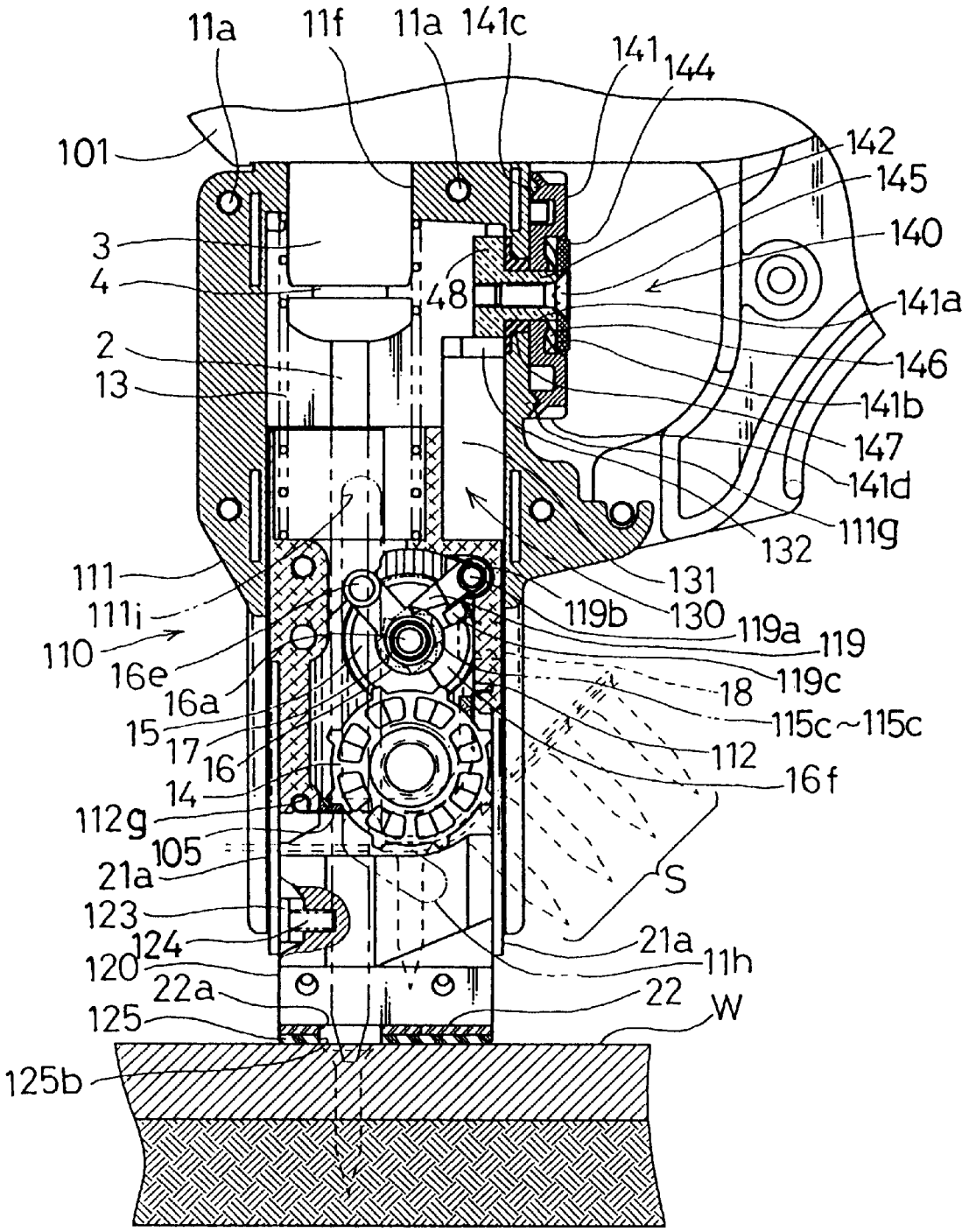
FIG. 21 is a view similar to FIG. 20 but showing the operation when the tool body has been pressed downwardly to its lowermost position to drive the screw into a work.

The second embodiment is a modification of the first embodiment, and therefore, like members are given the same reference numerals and their description will not be repeated. FIGS. 19 to 21 show a screw feeding device 110 of this embodiment. In these drawings, a tool body 101 of a continues screw driving tool is shown only by its lower portion. The screw feeding device 110 is shown in detail in FIG. 17 and includes a casing 111 and a feeder box 112.

Figure 23:
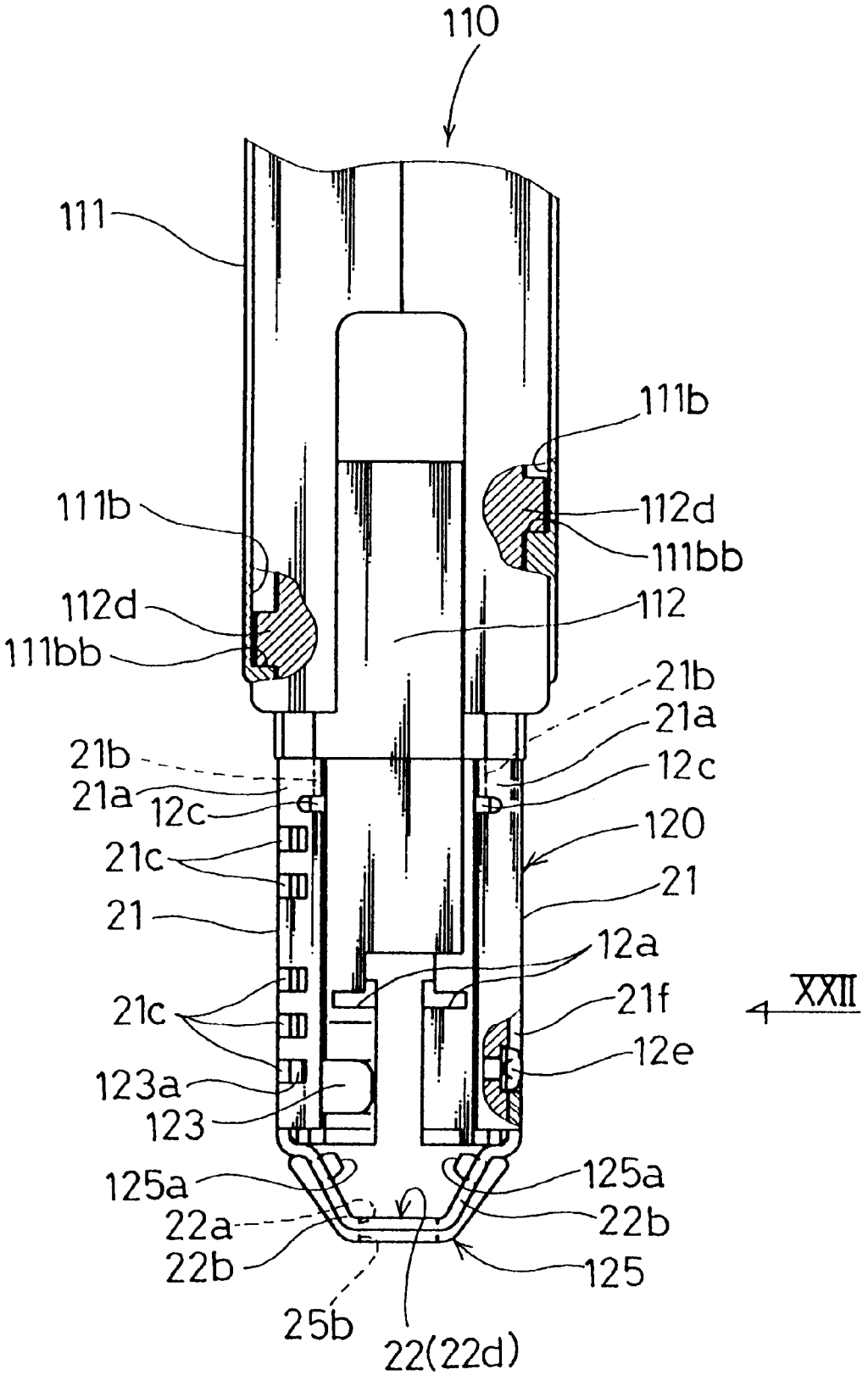
FIG. 23 is a view in a direction of arrow XXIII in FIG. 19 and showing the front view of the screw feeding device.
Figure 24:
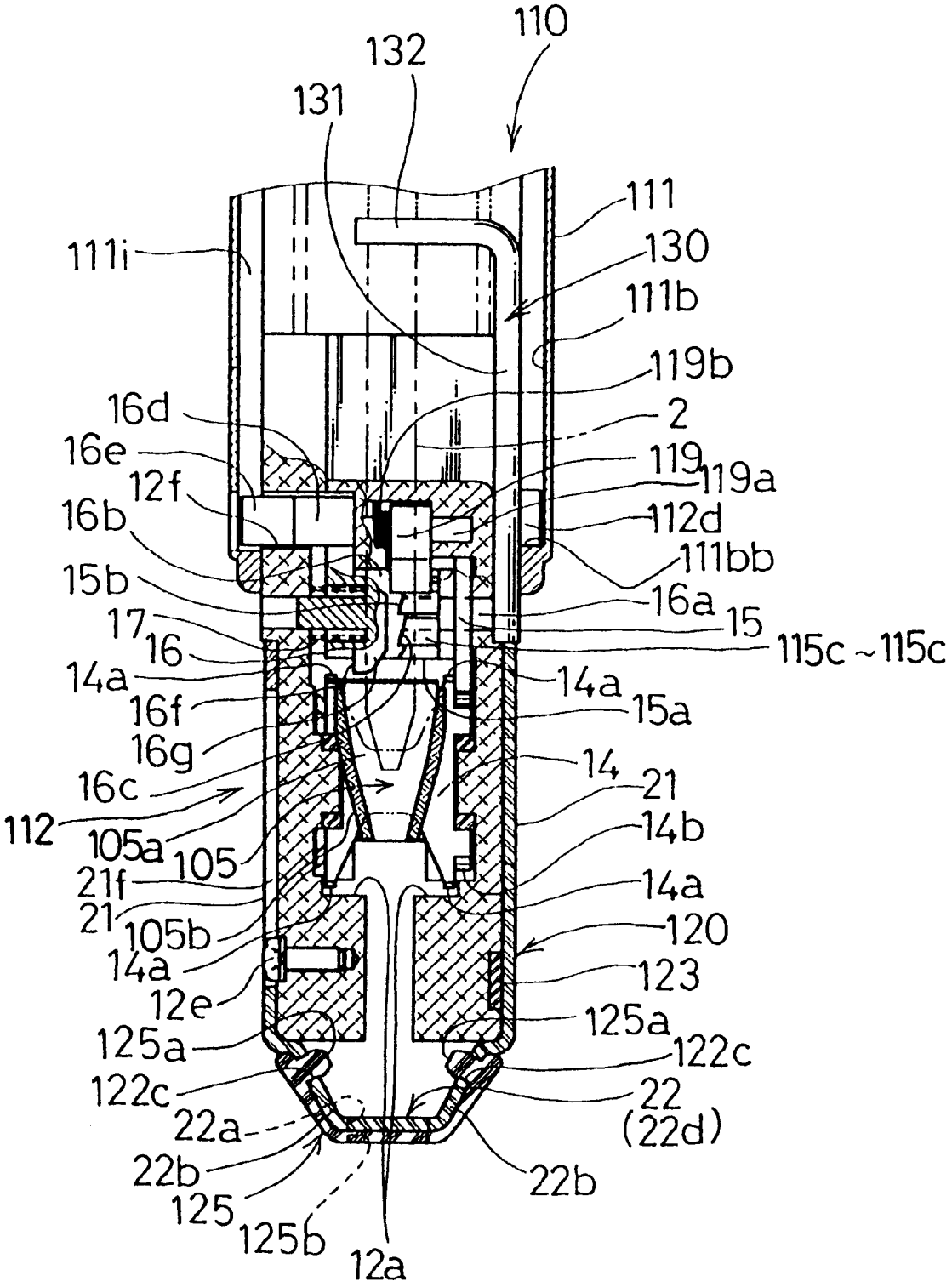
FIG. 24 is a sectional view taken along line XXIV—XXIV in FIG. 19 as viewed from the rear side of the screw feeding device.
Figure 25:
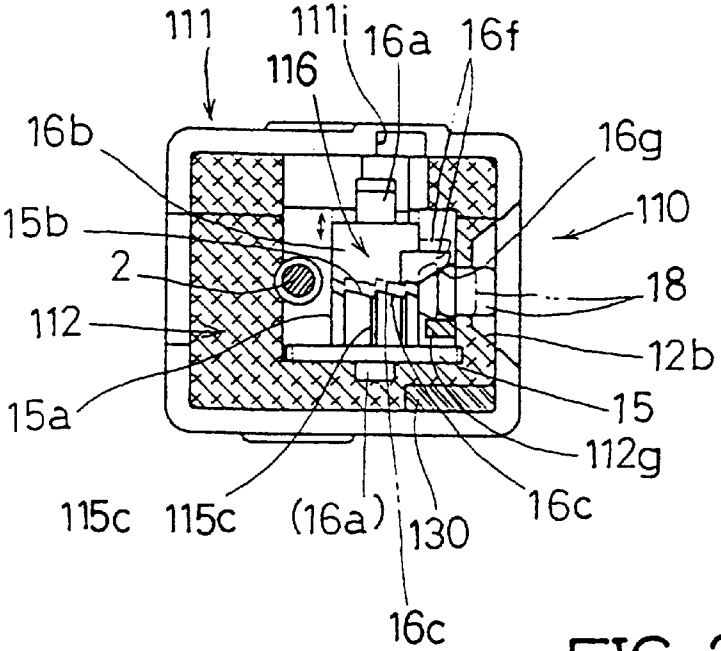
FIG. 25 is a sectional view taken along line XXV—XXV in FIG. 17 and showing the ratchet wheel as viewed from its lower side.

In place of the bolt 12*d* of the first embodiment, the feeder box 112 of this embodiment includes a pair of protrusions 112*d* formed on both lateral sides thereof as shown in FIGS. 23 and 24. A pair of guide recesses 111*b* are formed in the inner surface of the lateral walls of the casing 111. The feeder box 112 can be smoothly vertically moved with the protrusions 112*d* guided by their corresponding guide recesses 111*b*.

The lower stroke end of the feeder box 112 is limited through abutment of the protrusions 112*d* on bottoms 111*bb* of the corresponding guide recesses 111*b*.

Figure 22:
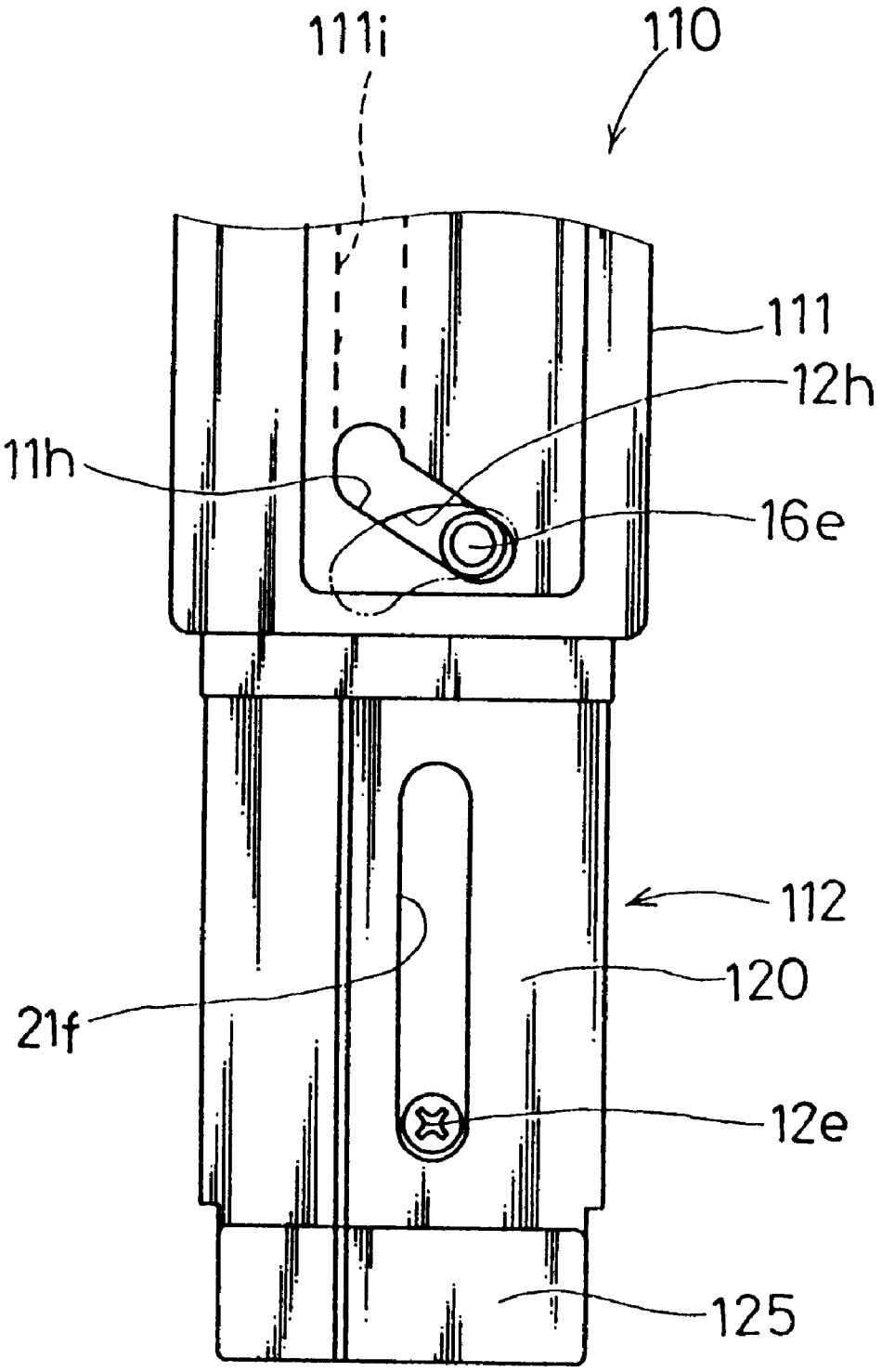
FIG. 22 is a side view in a direction of arrow XXII in FIG. 23 and showing the positional relation of a guide roller relative to a slant portion of a guide recess.

In place of the guide recess 11*d* of the casing 11 of the first embodiment, as shown in FIG. 22, a guide recess 111*i* is formed in the inner surface of one of the lateral walls of the casing 111 for providing guide for the guide roller 16*e* mounted on the support leg 16*d* of the ratchet arm 16.

In addition, in place of the leaf spring 19 of the first embodiment, a detent claw 119 is provided for preventing the intermediate gear 15 from rotating in the direction opposite to the feeding direction.

Figure 18:
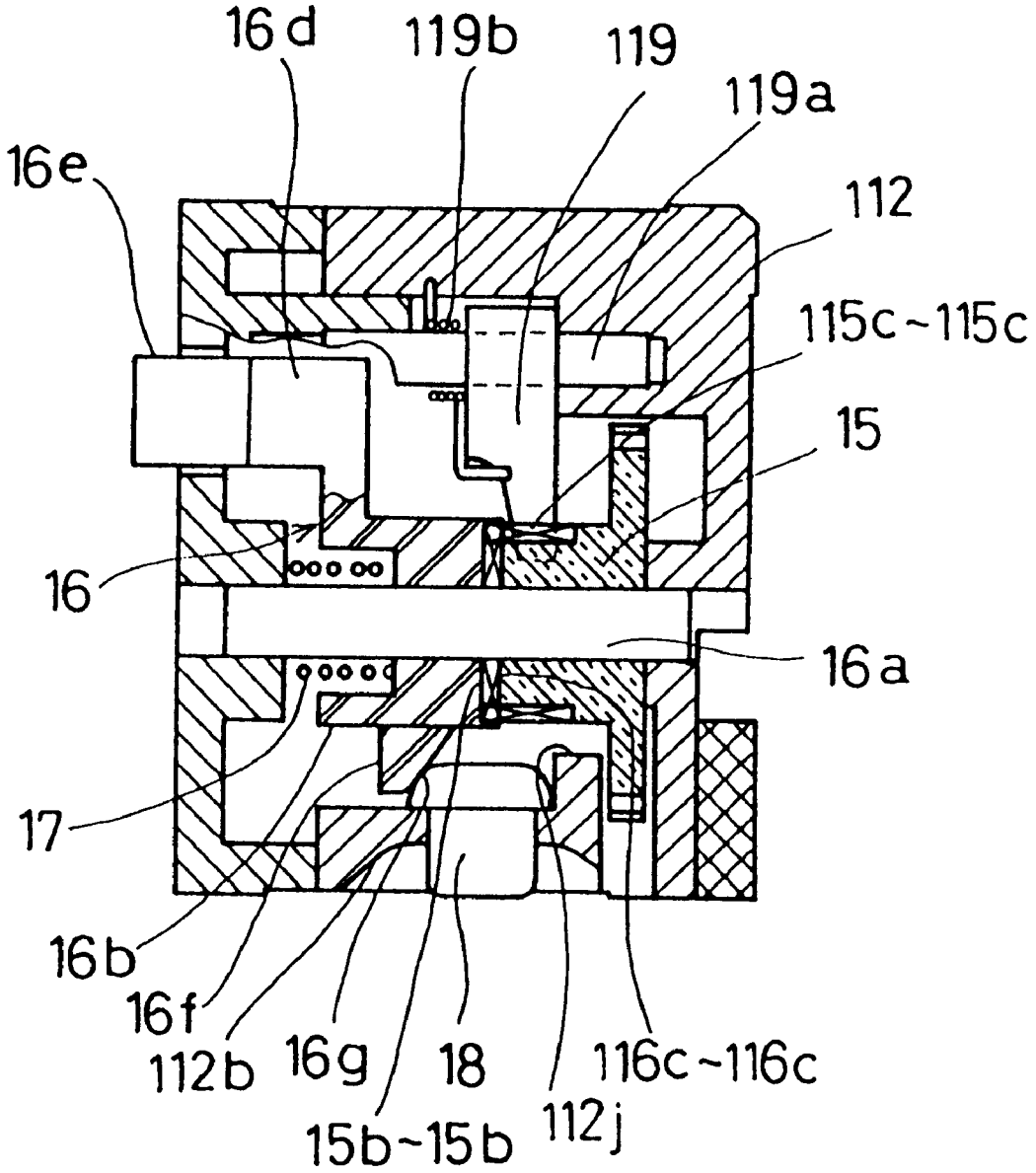
FIG. 18 is a sectional view taken along line XVIII—XVIII in FIG. 17 and showing the engaging state between a releasing button and a detent claw.

Further, as shown in FIG. 18, with the second embodiment, a support portion 112*i* is formed on the feeder box 112 to support the head of the releasing button 18 on the side opposite to the releasing portion 16*f* of the ratchet arm 16, so that the movement of the releasing button 18 in its axial direction can be smoothly effectively converted into the movement of the ratchet arm 16.

Figure 17:
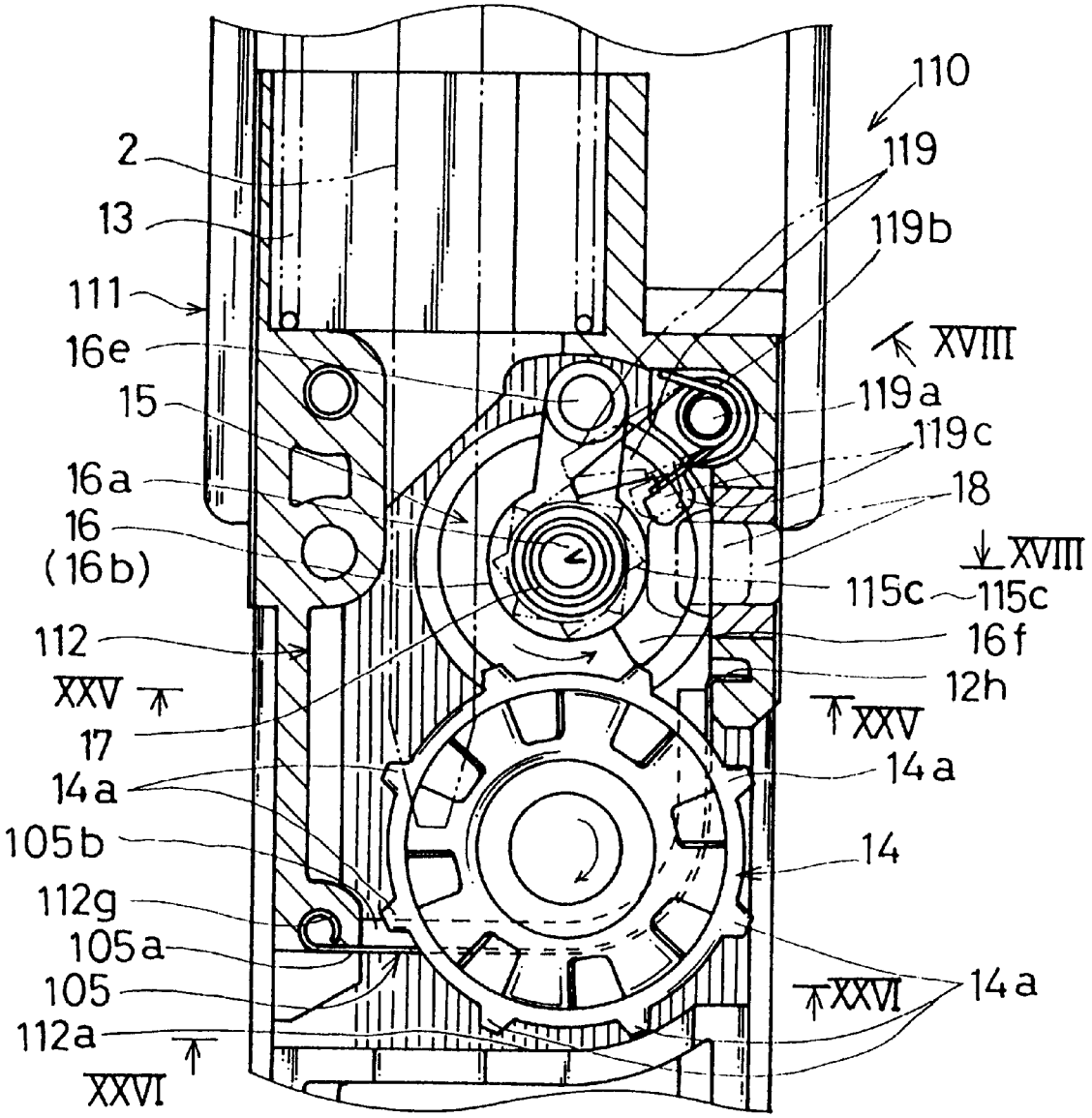
FIG. 17 is a view of the interior of a screw feeding device according to a second embodiment of the present invention.

As shown in FIGS. 18 and 24, the intermediate gear 15 of this embodiment includes a plurality of second engaging claws 115*c* formed thereon and are spaced from each other by the same distance as that of the engaging claws 15*b*. The engaging claws 115*c* are adapted for engagement with the detent claw 119 described above. As shown in FIGS. 17 and 18, the detent claw 119 is pivotally mounted on the feeder box 112 by means of a support shaft 119*a* and is positioned on the lateral side of the intermediate gear 15. A torsion coil spring 119*b* is fitted on the support shaft 119*a* and has one end engaged with the feeder box 12 and has the other end engaged with the detent claw 119, so that the detent claw 119 is biased in such a direction that its front end is pressed toward the second engaging claws 115*c* for engagement with either one of them. The intermediate gear 15 is thus prevented from rotation in the direction opposite to the feeding direction.

With the intermediate gear 15 prevented from rotation, the ratchet arm 16 may not be rotated with the intermediate gear 15 when the ratchet arm 16 is pivoted in the direction opposite to the feeding direct ion after the screw carrying belt S has been fed by the distance of one pitch of the screws. Therefore, the ratchet arm 16 is pivoted relative to the intermediate gear 15 while the ratchet arm 16 is moved in the axial direction as described in connection with the first embodiment. In addition, with the intermediate gear 15 prevented from rotation in the direction opposite to the feeding direction, the ratchet wheel 14 may not be rotated in the same direction, so that the screw carrying belt S may not be removed from the ratchet wheel 14.

As shown in FIG. 17, a releasing member 119*c* is provided on the detent claw 119 and is in abutment on the head of the releasing button 18. Therefore, when the operator pushes the releasing button 18, the ratchet arm 16 is disengaged from the intermediate gear 15 , and at the same time therewith, the detent claw 119 is pivoted to be disengaged from the engaging protrusion 115*c* in the clockwise direction as viewed in FIG. 17.

Thus, with this second embodiment, the releasing button 18 is operable to disengage both the ratchet arm 16 and the detent claw 119 from the intermediate gear 15, so that the intermediate gear 15 as well as the ratchet wheel 14 can rotate in the direction opposite to the feeding direction for removing the screw carrying belt S.

Figure 26:
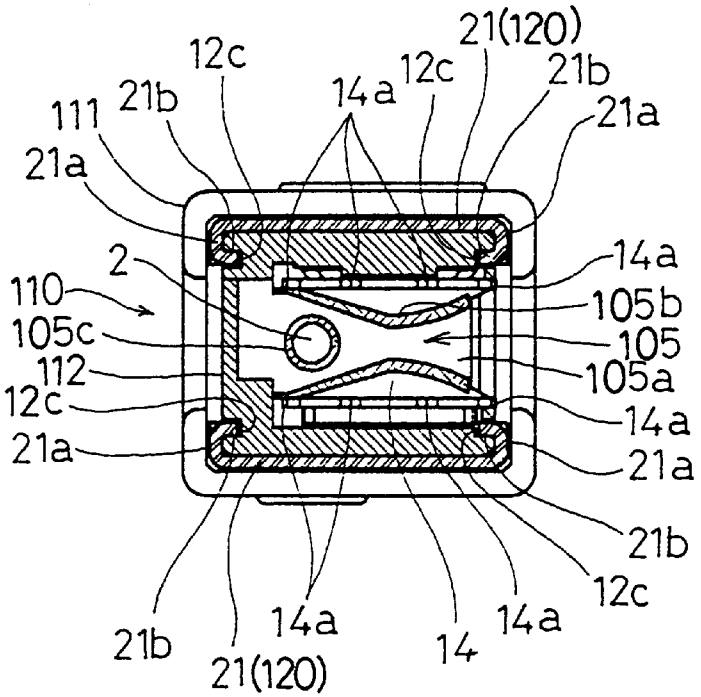
FIG. 26 is a sectional view taken along line XXVI—XXVI in FIG. 17 and showing the engaging relation between an intermediate gear and a ratchet arm as well as the abutting relation of the releasing button on a releasing member of the detent claw.

Further, as shown in FIGS. 17, 23 and 26, a dust prevention cover 105 is mounted between the bifurcated portions of the feeder box 112 and is positioned below the ratchet wheel 14. The dust prevention cover 105 comprises a leaf spring 105*a* and a felt sheet 105*b* attached to the inner side of the leaf spring 105*a*. The leaf spring 105*a* has both ends in engagement with the feeder box 112.

As shown in FIGS. 18, 23 and 26, the feeder box 112 is split into two parts each having engaging recesses 112*g* and 112*h* formed therein (see FIG. 17). The dust prevention cover 105 can be easily mounted on the feeder box 12 by firstly engaging both ends of the leaf spring 105*a* with the engaging recesses 112*g* and 112*h* of one of the split parts and by subsequently overlaying the other split part on this one split part, so that both ends of the leaf spring 105*a* are brought to also engage the corresponding engaging recesses 112*g* and 112*h* of the other split part. Thus, with this arrangement, the dust prevention cover 105 can be easily mounted within the feeder box 112 without using fixing screws or like when the feeder box 112 is assembled.

With the provision of the dust prevention cover 105, the ratchet wheel 14 and other parts positioned deeper into the feeder box 112 than the ratchet wheel 14 are covered by the dust prevention cover 105. This means that the parts within the screw feeding device 110 can be prevented from deposition of dusts. In addition, the felt sheet 105*b* of the dust prevention cover 105 extends to substantially contact the ratchet wheel 14, so that there is no substantial space between the felt sheet 105*b* and the ratchet wheel 14. Therefore, the dust prevention function of the dust prevention cover 105 can be effectively performed.

Further, as shown in FIG. 26, the dust prevention cover 105 is formed with an insertion hole 105*c* for passage of the driver bit 2. A space within the insertion hole 105*c* about the driver bit 2 is closed by the felt material 105*b*, so that the dust is also prevented from entering the insertion hole 105*c*.

The conventional screw feeding device has never been constructed to prevent dust as in this embodiment. During the screw driving operation, dusts may be produced and enter the interior of the screw feeding device, resulting in that the device cannot be operated properly. The dust preventing cover 105 of this embodiment ensures that the dusts may not enter the interior of the screw feeding device 110, so that the screw feeding device 110 may not cause any problem such as an improper operation.

Here, the felt sheet 105*b* may be replaced by any other material such as a rubber sheet. In addition, the leaf spring 105*a* may be replaced by a steel sheet or a plastic sheet which does not have resiliency. Further, although the dust prevention cover 105 of this embodiment is of a two-layer construction, it may be of a single layer construction comprising only a rubber sheet, felt sheet or a plastic sheet.

A stopper base 120 of the second embodiment will now be explained with reference to FIGS. 19 to 24.

As with the stopper base 20 of the first embodiment, the stopper base 120 of this embodiment has a substantially U-shaped configuration and includes the vertical members 21 and the transverse member 22 connected therebetween. The stopper base 120 is different from the stopper base 20 in that lock holes 21*c* are formed only in one of the retainer wall 21*a* of the vertical member 21 positioned on the left side as viewed in FIG. 23 and that the lock holes 21*c* are five in number.

A lock lever 123 for fixing the vertical position of the stopper base 120 is shown in FIGS. 19 to 21, 23 and 24. As shown in FIGS. 19 to 21, the lock lever 123 has a substantially L-shaped configuration and includes a lock protrusion 123*a*. The lock lever 123 is biased by a compression spring 124 in such a direction that the lock protrusion 123*a* is inserted into any of the lock holes 21*c*. When the operator pushes the lock lever 123 with his fingers against the biasing force of the spring 124, the lock protrusion 123*a* is removed from the lock holes 21*c*, so that the operator can change the vertical position of the stopper base 120 relative to the feeder box 112. With the stopper base 120 moved to a position where the lock protrusion 123*a* confronts the other one of the lock holes 21*c*, the operator releases the lock lever 123, so that the lock protrusion 123*a* automatically engages the desired lock hole 21*c*.

A cap 125 made of resilient rubber is attached to the lower surface of the transverse member 22 of the stopper base 120. As shown in FIGS. 23 and 24, the cap 125 extends over the lower surface of the transverse member 22 including an abutting surface 22*d* and inclined surfaces 22*b* positioned on both sides of the abutting surface 22*d*. The cap 125 has a pair of engaging protrusions 125*a* which are forcibly fitted within engaging holes 122*c* formed in the inclined surfaces 22*b* through resilient deformation of the engaging protrusions 125*a*, so that the cap 125 is detachable from the stopper base 120. The central portion of the cap 125 includes a rectangular hole 125*b* which is in alignment with the rectangular hole 22*a* of the transverse member 22.

With the provision of the cap 125 thus mounted, since the cap 125 is made of resilient rubber, the stopper base 120 is prevented from slippage on the work W. In addition, the work W may not be damaged by the stopper base 120 during the screw driving operation. Further, since the cap 125 is mounted on the stopper base 120 utilizing the resiliency of the engaging protrusions 125*a*, the cap 125 can be easily removed and replaced by new one when it has been damaged.

Since the cap 125 extends over the abutting surface 22*d* of the transverse member 22 and the inclined surfaces 22*b* positioned on both sides thereof, the cap 125 may not be accidentally removed from the stopper base 120 even if a force in the horizontal direction has been applied to the stopper base 120, so that the screw feeding device 110 of this embodiment is excellent in operability in this respect.

A stroke converting member 130 is shown in FIGS. 19 to 21 and 24. As with the stroke converting member 30 of the first embodiment, the stroke converting member 130 is interposed between the feeder box 112 and the casing 111 and has a substantially L-shaped configuration comprising a vertical part 131 and a horizontal part 132 connected thereto. The vertical part 131 is positioned between the feeder box 112 and the casing 111 and the lower end of the vertical part 131 is rest on the upper end of the stopper base 120, so that the converting member 130 is vertically movable with the feeder box 112 while the vertical position of the converting member 130 is automatically changed as the vertical position of the stopper base 120 is changed from one of the five different positions to the other.

FIGS. 19 to 24 show the state where the lock protrusion 123*a* is inserted into the lock hole 21*c* in the lowermost position, so that the stopper base 120 is set in the uppermost position relative to the feeder box 112. In this state, the stroke conversion member 130 is in the uppermost position relative to the feeder box 112, so that the stroke of the feeder box 112 is determined to be shortest.

On the other hand, when the lock protrusion 123*a* is inserted into the lock hole 21*c* in the uppermost position, the stroke converting member 130 is set in the lowermost position relative to the feeder box 112, so that the stroke of the feeder box 112 is determined to be greatest.

With this change in position of the stroke converting member 130 relative to the feeder box 112, the upper stroke end of the feeder box 112 relative to the casing 111 can be changed by five steps or at five different positions.

As shown in FIGS. 19 to 21, a stroke adjusting mechanism 140 is positioned upwardly of the stroke conversion member 130.

As shown in these figures, a disk-like adjusting knob 141 is rotatably mounted on an upper portion of a side wall of the casing 111 by means of a shifter pin 142. The shifter pin 142 is inserted into a central hole 141*a* formed in the adjusting knob 141. The shifter pin 142 is axially movable relative to the adjusting knob 141 but is not rotatable relative thereto. Thus, although the shifter pin 142 is axially movable relative to the adjusting knob 141, the shifter pin 142 is rotated together with the adjusting knob 141 when the operator rotates the adjusting knob 141.

A washer 144 is secured to an outer end of the shifter pin 142 by means of a flush head screw 145. An annular recess 141*b* is formed in the adjusting knob 141 and has an open end confronting the washer 144. A compression spring 146 is interposed between the bottom of the annular recess 141*b* and the washer 144, so that the adjusting knob 141 is normally biased to abut on the side wall of the casing 111, while the shifter pin 142 is biased in such a direction that the shifter pin 142 extends outwardly (rightwardly as viewed in FIG. 19) from the central hole 141*a* of the adjusting knob 141.

As with the first embodiment, a projection 111*g* is formed on the front surface of the casing 111 in a position confronting the periphery of the rear surface of the adjusting knob 141 which includes a plurality of conical depressions 141*c* arranged in the circumferential direction, so that the adjusting knob 141 can be held in the adjusted position and that an excellent operation feeling (click feeling) is given to the operator when he rotates the adjusting knob 141. In addition, a plurality of fin- like protrusions 141*d* are formed on the outer periphery of the adjusting knob 141 and serve to prevent slippage of fingers of the operator when he rotates the adjusting knob 141. The shifter pin 142 has an inner end which extends into the interior of the casing through a bearing 147.

The inner end of the shifter pin 142 has a cam 148 which is formed integrally with the shifter pin 142. The cam 148 has a diameter gradually varying in its circumferential direction and is positioned above the stroke converting member 130.

With the shifter pin 142 thus constructed, by rotating the cam 148 to a suitable position by means of the adjusting knob 141, the abutting position of the horizontal part 132 of the stroke converting member 130 on the cam 148 or the upper stroke end of the feeder box 112 can be varied sequentially. Thus, fine adjustment of the stroke of the feeder box 112 can be performed.

With the provision of this stroke adjusting mechanism 140, in addition to the selection of the stroke of the feeder box 112 among five different values performed by changing the position of the stroke converting member 130 relative to the feeder box 112 or by changing the position of the stopper base 120, the fine adjustment can be performed with respect to each selected stroke.

The operation of the second embodiment will now be described with reference to FIGS. 19 to 21.

FIG. 19 shows the state where the stopper base 120 is in abutment on the upper surface of the work W but where the tool body 101 is not pressed downwardly, so that the screw feeding device 110 is in an inoperative position. In this position, the protrusions 112*d* are in abutment on the bottom 111*bb* of the guide recesses 111*b* (see FIG. 23), so that the feeder box 112 is in its lowermost stroke end and that the guide roller 16*e* is at the lower end of the slant part 111*h* of the guide recess 111*i* (see FIG. 22).

When the operator presses the tool body 101 downwardly, the feeder box 112 moves upwardly within the casing 111 against the biasing force of the spring 13 as shown in FIG. 20. As the feeder box 112 is moved upwardly, the guide roller 16*e* is moved leftwardly (counterclockwise) along the slant part 111*h* of the guide recess 111*i*, so that the ratchet arm 16 is pivoted in the feeding direction as indicated by an arrow in FIG. 20.

As described in connection with the first embodiment, as the ratchet arm 16 is pivoted, the intermediate gear 15 is rotated through engagement between the engaging claws 15*b* and 16*c*, so that the ratchet wheel 14 is rotated to feed the screw carrying belt S by the distance of one pitch of the screws carried thereon and that the screw to be driven is set below the driver bit 2.

As the operator further presses the tool body 101, the feeder box 112 is further moved upwardly relative to the casing 111, so that the lower end of the driver bit 2 is brought to abut on the head of the screw. Then the driver bit 2 is started to be rotated and the screw is removed from the screw carrying belt S. At substantially the same time with the removal of the screw from the screw carrying belt S, the screw is brought to abut on the work W and is driven into the same. FIG. 21 shows the state where the screw has been completely driven into the work W.

When the screw has been completely driven, the transverse member 132 of the stroke converting member 30 is brought to abut on the peripheral surface of the cam 48, and the feeder box 112 reaches its upper stroke end. This means that the casing 111 as well as the tool body 101 reaches its lower stroke end.

Then, the operator releases the pressing force applied to the tool body 101, so that the feeder box 112 is moved downwardly relative to the casing 111 by the biasing force of the spring 13 and that the ratchet arm 16 is pivoted in the direction opposite to the feeding direction by the movement of the guide roller 16*e* along the slant part 111*h* of the guide recess 111*i* from the position shown in FIG. 20 to the position shown in FIG. 19. Since the detent claw 119 is in engagement with the second engaging claws 115*c* of the intermediate gear 15 as shown by solid lines in FIG. 17, the intermediate gear 15 may not be rotated in the direction opposite to the feeding direction. Therefore, the ratchet arm 16 is axially moved against the biasing force of the spring 17 as it is pivoted in the direction opposite to the feeding direction, so that the engaging claws 16*c* and 15*b* are disengaged from each other. The ratchet arm 16 is thus pivoted in the direction opposite to the feeding direction by the distance corresponding to one pitch of the screws. At the same time therewith, the guide roller 16*e* reaches the lower end of the slant part 111*h* of the guide recess 111*i*, and the protrusions 112*d* are brought to abut on the bottom 111*bb* of the guide recess 111*b*. Thus, the feeder box 112 reaches its lower stroke end. One cycle of the screw driving operation is thus completed.

In order to draw out the screw carrying belt S from the screw feeding device 110, the operator pushes the releasing button 18 so as to move the same to a position indicated by chain lines in FIG. 17. As the releasing button 18 is thus moved, the ratchet arm 16 is moved axially against the biasing force of the spring 17 through abutment of the head of the releasing button 18 on the inclined surface 16*g* of the releasing member 16*f*, so that the engaging claws 15*b* and 16*c* are disengaged from each other as described in connection with the first embodiment.

On the other hand, as the releasing button 18 is thus moved, the detent claw 119 is pivoted in the clockwise direction as viewed in FIG. 17 to a position indicated by chain lines in FIG. 17 against the biasing force of the torsion spring 119*b* through abutment of the head of the releasing button 18 on the releasing member 119*c* of the detent claw 119, so that the detent claw 119 is disengaged from the engaging claws 115*c*.

Thus, by pushing the releasing button 18, the engaging claws 15*b* and 16*c* are disengaged from each other, and at the same time therewith, the detent claw 119 is disengaged from the engaging claws 115*c*. The intermediate gear 15 is then allowed to rotate in the direction opposite to the feeding direction, and the operator can withdraw the screw carrying belt S from the screw feeding device 110 since the intermediate gear 15 as well as the ratchet wheel 14 is rotated in the direction opposite to the feeding direction when he pulls the screw carrying belt S in the direction opposite to the feeding direction.

When the operator releases the releasing button 18, the releasing button 18 returns to the position indicated by solid lines in FIG. 17 by the forces of the springs 17 and 119*b*, so that the ratchet arm 16 is moved axially by the spring 17, resulting in that the engaging claws 16*c* and 15*b* are brought to engage each other and that the detent claw 119 is brought to engage the engaging claws 115*c* of the intermediate gear 15 so as to prevent the intermediate gear 15 from rotation in the direction opposite to the feeding direction.

As described above, with the second embodiment, the detent claw 119 serves to indirectly prevent rotation of the ratchet wheel 14 in the direction opposite to the feeding direction through engagement with the engaging claws 115*c* formed on the intermediate gear 15. Thus, the detent claw 119 does not serve to directly engage the ratchet wheel 14, and therefore, the wear of the feeding claws 14*a* of the ratchet wheel 14 may be substantially reduced in comparison with the case where a detent claw is directly engaged with feeding claws of a ratchet wheel.

In addition, with this embodiment, the movement of the screw carrying belt S is permitted when the releasing button 18 as a separate member from the detect claw 119 is operated. The detent claw 119 is in engagement with the engaging claws 115*c* of the intermediate gear 15 and is pivoted at each time when the screw carrying belt S is fed by one pitch of the screws. In contrast, the releasing button 18 is moved only when the screw carrying belt S is required to be moved in the direction opposite to the feeding direction. Therefore, the releasing button 18 and the parts disposed about the releasing button 18 may be improved in their durability in comparison with the construction in which a detent claw and a releasing button are constituted by a single member.

Further, with the provision of the dust preventing cover 105, the dusts which may be produce during the screw driving operation may not enter the interior of the screw feeding device 110, so that the screw feeding device 110 can be reliably operated and may have excellent durability.

Furthermore, with the provision of the cap 125 which has a substantially V-shaped configuration extending over the abutting surface 22*d* of the transverse member 22 of the stopper base 120 and the inclined surfaces 22*b* on both side of the abutting surface 22*d*, the cap 125 may not be easily removed even if a force is applied in the horizontal direction, so that the screw feeding device 110 may have an excellent operability.

Although, in the above embodiment, the disengagement between the ratchet arm 16 and the intermediate gear 15 as well as the disengagement between the detent claw 119 and the intermediate gear 15 is performed by pushing the releasing button 18, this embodiment may be modified such that the disengagement is performed by pulling or pivoting a releasing member corresponding to the releasing button 18.

While the invention has been described with reference to preferred embodiments thereof, it is to be understood that modifications or variations may be easily made without departing from the spirit of this invention which is defined by the appended claims.

What is claimed is:

1. A screw feeding device in a continuous screw driving tool, comprising:

a casing mounted on a tool body of the continuous screw driving tool;

a feeder box reciprocally movable within said casing;

a ratchet arm reciprocally pivotable as said feeder box is reciprocally moved;

an intermediate gear connected to said ratchet arm by means of a one-way clutch, said intermediate gear being rotatable by a predetermined angle as said ratchet arm is pivoted in one direction;

a ratchet wheel having feeding claws engageable with a screw carrying belt and having a gear part engaged with said intermediate gear, so that said ratchet wheel is rotated in a feeding direction as said intermediate gear is rotated and that the screw carrying belt is fed by a distance of one pitch of screws carried by the screw carrying belt for each reciprocal movement of said feeder box.

2. The screw feeding device as defined in claim 1 wherein said ratchet wheel is rotatably supported by said feeder box about a first axis , said intermediate gear is rotatably supported by said feeder box about a second axis parallel to said first axis, said second axis being displaced from said first axis in a direction opposite to a driving direction of the screws.

3. The screw feeding device as defined in claim 1 further including releasing means for releasing said one-way clutch for permitting rotation of said ratchet wheel in a direction opposite to the feeding direction.

4. The s crew feeding device as defined in claim 3 wherein said ratchet armies movable in an axial direction between a clutch operating position and a clutch releasing position, and wherein said releasing means includes a releasing button operable to move said ratchet arm from said clutch operating position to said clutch releasing position.

5. The screw feeding device as defined in claim 4 further including a spring for normally holding said ratchet arm in said clutch operating position, said releasing button being mounted on said feeder box so as to be movable in a direction perpendicular to the axial direction of said ratchet arm, and said ratchet arm including an inclined surface for abutment on one end of said releasing button, so that said ratchet arm is moved toward said clutch releasing position through abutment of said one end of said releasing button on said inclined surface when said releasing button is pushed against the biasing force of said spring.

6. The screw feeding device as defined in claim 4 wherein said ratchet arm and said intermediate gear are supported on a common shaft.

7. The screw feeding device as defined claim 3 further including detent claw means including a detent claw and engaging claws, said detent claw being mounted on said feeder box, said engaging claws being provided on said intermediate gear for engagement with said detent claw, and said releasing means being operable to release engagement between said detent claw and said engaging claws at the same time said one-way clutch is released.

8. The screw feeding device as defined in claim 7 wherein said ratchet arm is movable relative to said feeder box in an axial direction between a clutch operating position and a clutch releasing position, wherein said detent claw is movable relative to said feeder box between an engaging position with said engaging claws and a disengaging position, and wherein said releasing means includes a releasing button for moving said ratchet arm from said clutch operating position to said clutch releasing position and for moving said detent claw from said engaging position to said disengaging position.

9. The screw feeding device as defined in claim 8 wherein said detent claw includes a releasing member for abutment on said releasing button when said releasing button is pushed into said feeder box.

10. The screw feeding device as defined in claim 1 further including resistance means for providing predetermined resistance against rotation of said ratchet wheel.

11. The screw feeding device as defined in claim 10 wherein said resistance means is a leaf spring having one end mounted on said feeder box and having the other end or a free end which resiliently contacts an outer periphery of said ratchet wheel.

12. The screw feeding device as defined in claim 11 wherein said feeding claws are formed on said outer periphery of said ratchet wheel, and wherein said free end of said leaf spring includes a proximal end which is brought to abut on one of said feeding claws in the direction opposite to the feeding direction when said screw carrying belt has been fed to a position for driving the screw.

* * * * *